US007470855B2

(12) United States Patent
Sakama et al.

(10) Patent No.: US 7,470,855 B2
(45) Date of Patent: Dec. 30, 2008

(54) TONE CONTROL APPARATUS AND METHOD

(75) Inventors: Masao Sakama, Shizuoka-ken (JP); Shinya Koseki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 580 days.

(21) Appl. No.: 11/091,865

(22) Filed: Mar. 28, 2005

(65) Prior Publication Data

US 2005/0211074 A1 Sep. 29, 2005

(30) Foreign Application Priority Data

Mar. 29, 2004 (JP) ..... 2004-095435
Mar. 29, 2004 (JP) ..... 2004-095436

(51) Int. Cl.
*G10H 7/00* (2006.01)
*G10H 1/02* (2006.01)
*G10H 1/06* (2006.01)

(52) U.S. Cl. ..... 84/626; 84/604; 84/622; 84/663

(58) Field of Classification Search ..... 84/626, 84/604, 622, 663
See application file for complete search history.

(56) References Cited

U.S. PATENT DOCUMENTS 4,383,462 A * 5/1983 Nagai et al. ..... 84/604
5,033,352 A * 7/1991 Kellogg et al. ..... 84/658
5,160,799 A * 11/1992 Tozuka et al. ..... 84/653
5,218,158 A * 6/1993 Kimura ..... 84/663
5,569,870 A * 10/1996 Hirano ..... 84/615
5,726,371 A * 3/1998 Shiba et al. ..... 84/603
5,750,914 A * 5/1998 Takahashi ..... 84/626
6,150,598 A * 11/2000 Suzuki et al. ..... 84/603
6,281,423 B1 * 8/2001 Shimizu et al. ..... 84/622
6,365,818 B1 * 4/2002 Suzuki ..... 84/604
6,376,760 B1 * 4/2002 Tozuka et al. ..... 84/635
6,392,135 B1 * 5/2002 Kitayama ..... 84/622
6,403,871 B2 * 6/2002 Shimizu et al. ..... 84/622

(Continued)

FOREIGN PATENT DOCUMENTS

JP 2187794 7/1990

(Continued)

OTHER PUBLICATIONS

European Search Report dated Aug. 24, 2005.

*Primary Examiner*—Walter Benson
*Assistant Examiner*—Christina Russell
(74) *Attorney, Agent, or Firm*—Harness, Dickey & Pierce, PLC

(57) ABSTRACT

Rendition style parameters for realizing various release rendition styles and/or attack rendition styles are stored in a memory. Operation-related time lengths are detected which pertain to turning-on and/or turning-off operation of a pedal operator. Any one of the release rendition style parameters is selected from the memory on the basis of the detected operation-related time length, and the release of a tone is controlled with a characteristic of the selected rendition style parameter. Alternatively, any one of the release or attack rendition style parameters is selected from the memory on the basis of a velocity of the turning-on and/or turning-off operation of the pedal operator detected operation-related time length, and the release or attack of a tone is controlled with a characteristic of the selected rendition style parameter.

18 Claims, 10 Drawing Sheets

U.S. PATENT DOCUMENTS

| | | | | |
|---|---|---|---|---|
| 6,584,442 | B1 * | 6/2003 | Suzuki et al. | 704/500 |
| 6,798,427 | B1 * | 9/2004 | Suzuki et al. | 84/604 |
| 6,881,888 | B2 * | 4/2005 | Akazawa et al. | 84/604 |
| 6,911,591 | B2 * | 6/2005 | Akazawa et al. | 84/616 |
| 7,271,330 | B2 * | 9/2007 | Akazawa et al. | 84/626 |
| 2002/0023530 | A1 * | 2/2002 | Komano et al. | 84/622 |
| 2003/0084778 | A1 * | 5/2003 | Suzuki et al. | 84/604 |
| 2003/0172799 | A1 * | 9/2003 | Sakurai et al. | 84/622 |
| 2004/0055449 | A1 * | 3/2004 | Akazawa et al. | 84/626 |
| 2004/0267791 | A1 * | 12/2004 | Sunako | 707/100 |
| 2005/0061141 | A1 * | 3/2005 | Yamauchi | 84/600 |
| 2005/0188819 | A1 * | 9/2005 | Lin et al. | 84/603 |

FOREIGN PATENT DOCUMENTS

| | | |
|---|---|---|
| JP | 05-019755 | 1/1993 |
| JP | 2000-172264 | 6/2000 |
| JP | 2001-215971 | 8/2001 |
| JP | 2002-041041 | 2/2002 |
| JP | 2004045832 | 2/2004 |
| JP | 2004-078095 | 3/2004 |

* cited by examiner

TONE CONTROL APPARATUS AND METHOD

BACKGROUND OF THE INVENTION

The present invention relates to tone control apparatus and methods for controlling generation of tones while imparting various types of rendition styles (or articulation) to musical tones, or voices or other desired sounds in response to operation by a user, as well as computer programs for such tone generation. More particularly, the present invention relates to an improved tone control apparatus and method, which, in response to operation, by a user, of only a same operator, can control tone generation in real time while imparting the tones with any of a plurality of different release rendition styles (or attack rendition styles) that faithfully express tone color variations specific to natural musical instruments or tone color variations based on various types of articulation, as well as a computer program for such tone generation. The present invention can be extensively applied to not only electronic musical instruments but also all fields of other equipment, apparatus and methods, such as automatic performance apparatus, computers, electronic game apparatus and other multimedia equipment, which have functions of generating tones, voices or other desired sounds.

Today, various apparatus are known which are intended to achieve realistic reproduction and control of various rendition styles etc. that faithfully express tone color variations specific to natural musical instruments or tone color variations based on various types of articulation. Among examples of such apparatus is one that employs a tone waveform control technique commonly known as "SAEM" (Sound Articulation Element Modeling), which is disclosed, for example, in Japanese Patent Application Laid-open Publication No. 2004-78095 corresponding to the US2004-0055449 A1. In the apparatus employing the SAEM technique, whole waveforms corresponding to various rendition styles are prestored for individual partial sections, such as attack, release and body sections, of a tone, so that the tone can be formed by time-serially combining the prestored waveforms for the partial sections. Let it now be assumed that the term "tone" is used in this specification to refer to not only a musical tone but also a voice or any other type of sound.

With the conventionally-known technique, it is possible for the user to control tone generation while imparting tones with rendition styles, by appropriately operating any of a plurality of rendition style designating operators assigned to various rendition styles. For release-related rendition styles (i.e., release rendition styles), for example, rendition style designating operators (e.g., switches and/or pedals), functioning like rendition style switches, are assigned to various different release rendition styles, and generation of a tone can be controlled, through appropriate ON/OFF operation of any one of the rendition style designating operators, such that the tone is silenced (or released) by being imparted with the corresponding release rendition style. Similarly, for attack rendition styles, rendition style designating operators are assigned to various attack release rendition styles, and generation of a tone can be controlled, through appropriate ON/OFF operation of any one of the attack rendition style designating operators, such that the tone starts to be audibly generated (i.e., sounded) by being imparted with the corresponding attack rendition style. Namely, in the case where a release rendition style or attack rendition style is imparted by identifying only the ON or OFF state of the corresponding rendition style designating operator, there are provided a multiplicity of operators for selecting any desired one of a plurality of different release rendition styles, and thus the user has to appropriately select and operate a necessary one of the multiplicity of rendition style designating operators. However, it is extremely difficult for the user to control generation of tones while selecting and operating, at appropriate timing, the necessary rendition style designating operators, in addition to executing performance operation by operating a performance operator unit, such as a keyboard. Consequently, with the conventionally-known technique, it has been difficult for the user to play the performance operator unit while imparting release or attack rendition styles in real time.

SUMMARY OF THE INVENTION

In view of the foregoing, it is an object of the present invention to provide an improved tone control apparatus, method and program which allow a user to control generation of a tone with an appropriate release rendition style (or attack rendition style) reflected therein while readily controlling any one of a plurality of release rendition styles (or attack rendition styles) in real time.

According to a first aspect of the present invention, there is provided a tone control apparatus, which comprises: a performance device that instructs generation of a tone; an operator operable by a human player; a storage device that stores one or more rendition style parameters each for realizing a particular release rendition style in a release section of a tone; a detection section that, on the basis of an output of the operator, detects an operation-related time length of the operator when the operator has been operated in a predetermined manner; a selection section that, on the basis of the operation-related time length detected by the detection section, selects any one of the rendition style parameters from the storage device; and a tone generation control section that generates a tone in accordance with a tone generation instruction by the performance device and controls the generated tone to be silenced with a characteristic of a release rendition style corresponding to the rendition style parameter selected by the selection section.

In the present invention, a detection is made, on the basis of the output of the operator, of an operation-related time length of the operator when the operator has been operated in a predetermined manner, and any one of the rendition style parameters is selected from the storage device on the basis of the detected operation-related time length. The storage device has prestored therein one or more rendition style parameters each intended to realize a particular rendition style in a release section of a tone. Then, control is performed to silence a generated tone in accordance with the release rendition style corresponding to the selected rendition style parameter. Namely, the tone, having been started to be generated by the performance device, is silenced (released) in accordance with the rendition style parameter. In the aforementioned manner, any one of the plurality of rendition style parameters is selected in accordance with the detected operation-related time length of the operator, and the tone being generated is silenced on the basis of the selected rendition style parameter. Consequently, by only manipulating the single operator, the user is allowed to control generation of a tone with an appropriate release rendition style reflected therein while readily controlling in real time any one of the plurality of release rendition styles.

According to a second aspect of the present invention, there is provided a tone generation apparatus, which comprises: a performance device that instructs generation of a tone; an operator operable by a human player; a storage device that stores one or more rendition style parameters each for realizing a particular release rendition style in a release section of a tone; a generation section that, on the basis of an output of the operator, generates velocity data corresponding to at least one of turning-on operation and turning-off operation of the operator; a selection section that, on the basis of the velocity data generated by the generation section, selects any one of the rendition style parameters from the storage device; and a tone generation control section that generates a tone in accordance with a tone generation instruction by the performance device and controls the generated tone to be silenced with a characteristic of a release rendition style corresponding to the rendition style parameter selected by the selection section.

In the present invention, velocity data corresponding to turning-on operation or turning-off operation of the operator is generated on the basis of the output of the operator, and any one of the rendition style parameters is selected from the storage device on the basis of the generated velocity data. In the aforementioned manner, any one of the plurality of rendition style parameters is selected in accordance with ON velocity data or OFF velocity data of the operator, and the tone being generated is silenced on the basis of the selected rendition style parameter. Consequently, by only manipulating the single operator, the user is allowed to control generation of a tone with an appropriate release rendition style reflected therein while readily controlling in real time any one of the plurality of release rendition styles.

According to a third aspect of the present invention, there is provided a tone generation apparatus, which comprises: a performance device that instructs generation of a tone; an operator operable by a human player; a storage device that stores one or more rendition style parameters each for realizing a particular attack rendition style in an attack section of a tone; a generation section that, on the basis of an output of the operator, generates velocity data corresponding to turning-on operation of the operator; a selection section that, on the basis of the velocity data generated by the generation section, selects any one of the rendition style parameters from the storage device; and a tone generation control section that controls a tone, corresponding to a tone generation instruction by the performance device, to start to be generated with a characteristic of the attack rendition style corresponding to the rendition style parameter selected by the selection section. Consequently, by only manipulating the single operator, the user is allowed to control generation of a tone with an appropriate attack rendition style reflected therein while readily controlling in real time any one of the plurality of attack rendition styles.

Thus, the present invention allows the user to select an appropriate release or attack rendition style, from among the plurality of release or attack rendition styles, by just operating the single operator. As a result, the user can control in real time a plurality of release or attack rendition styles faithfully representing tone color variations specific to natural musical instruments or tone color variations based on various types of articulation, and thereby control generation of a tone with an appropriate release or attack rendition style reflected therein.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the objects and other features of the present invention, its preferred embodiments will be described herein below in greater detail with reference to the accompanying drawings, in which.

DETAILED DESCRIPTION OF THE INVENTION

Figure 1:
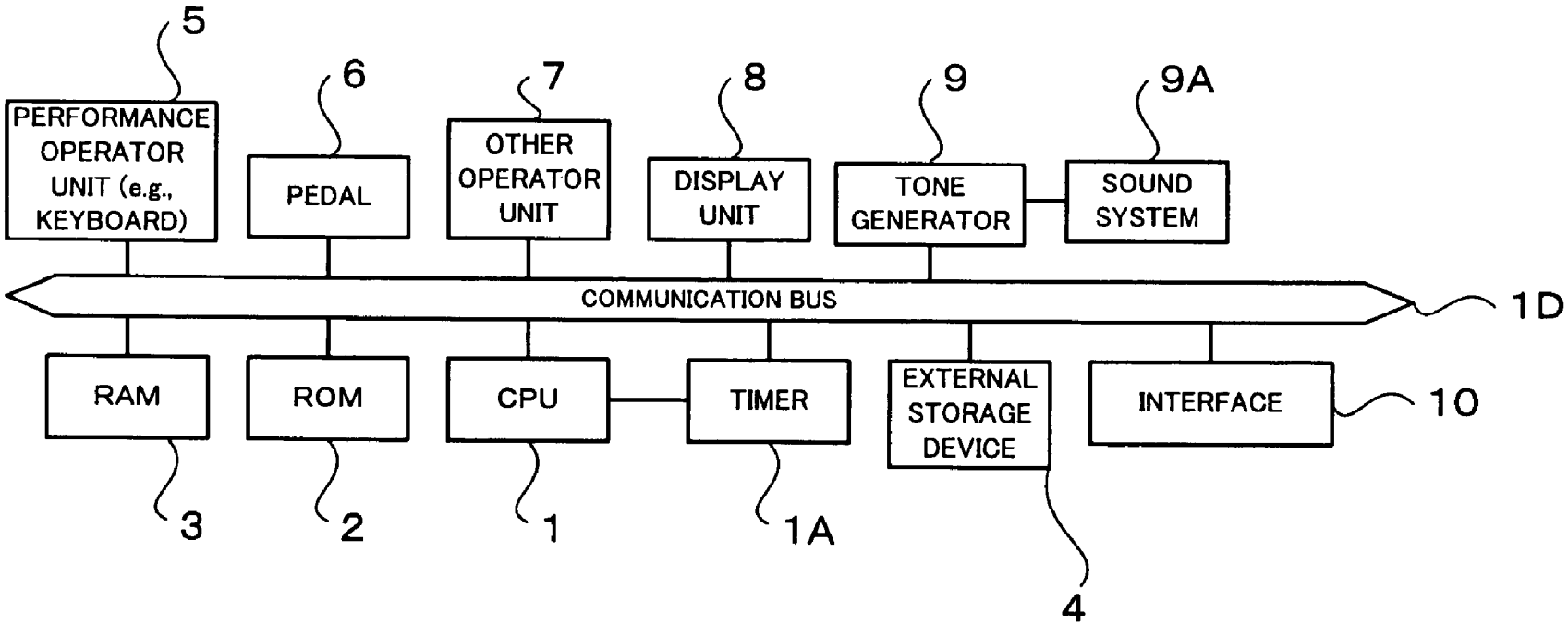
FIG. 1 is a block diagram showing an example general hardware setup of an electronic musical instrument to which is applied a tone control apparatus in accordance with a first embodiment of the present invention.

FIG. 1 is a block diagram showing an example general hardware setup of an electronic musical instrument to which is applied a tone control apparatus of the present invention. The electronic musical instrument illustrated here is constructed using a computer, in which control of tones to be generated is carried out by the computer executing predetermined software programs directed to tone control processing of the present invention. Of course, the tone control processing of the present invention may be implemented by microprograms for execution by a DSP (Digital Signal Processor), rather than by such computer software programs. Further, the tone control processing of the present invention may be implemented by a dedicated hardware apparatus that includes discrete circuits or integrated or large-scale integrated circuitry built therein. Further, the equipment to which is applied the tone control apparatus of the present invention may be other than an electronic musical instrument, such as an automatic performance apparatus like a sequencer, karaoke apparatus, electronic game apparatus or other type of multimedia-related equipment, personal computer or any other desired form of product. Namely, the tone control apparatus of the present invention may be applied to any apparatus or equipment, as long as the apparatus or equipment is constructed to perform tone generation control such that a tone, having been started to be audibly generated or sounded in response to user's turning-on (or key depression) operation of a keyboard (i.e., performance operator unit), is imparted with a suitable one of a plurality of different release rendition styles, in response to user's operation of a predetermined pedal (i.e., operator other than the keyboard) and by use of predetermined programs or hardware according to a first embodiment of the present invention, so as to silence (release) the generated tone. Note that, whereas the electronic musical instrument of FIG. 1 may include other hardware components than the above-mentioned, it will be described herein below as using only minimum necessary resources.

In the electronic music instrument of FIG. 1, various operations are carried out under control of a microcomputer including a microprocessor unit (CPU) 1, a read-only memory (ROM) 2 and a random memory (RAM) 3. The CPU 1 controls operation of the entire electronic musical instrument. To the CPU 1 are connected, via a communication bus (e.g., data and address bus) 1D, ROM 2, RAM 3, external storage device 4, performance operator unit 5, performance controlling operation pedal 6, other operator unit 7, display unit 8, tone generator (T.G.) 9 and interface 10. Also connected to the CPU 1 is a timer 1A for counting various times, for example, to signal interrupt timing for timer interrupt processes. Namely, the timer 1A counts a time interval, generate tempo clock pulses, and so on. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include "tone control processing" (see FIG. 4 to be later described) for performing control to silence a tone, audibly generated in response to operation, by a user, of a keyboard, by imparting the tone with an appropriate one of various release rendition styles specific to various musical instruments, intended for a more natural and realistic performance, in response to operation, by the user of, the single predetermined performance controlling operation pedal 6.

The ROM 2 stores therein various programs to be executed by the CPU 1 and various data. The RAM 3 is used as a working memory for temporarily storing various data generated as the CPU 1 executes predetermined programs, and as a memory for storing a currently-executed program and data related to the currently-executed program. Predetermined address regions of the RAM 3 are allocated to various functions and used as various registers, flags, tables, memories, etc. The external storage device 4 stores therein a parameter table (see FIG. 2 to be later described) containing a multiplicity of rendition style parameters that are tone control information for providing or realizing various rendition styles specific to various musical instruments, various data, such as tone waveform data prepared for various tone colors like piano tones, and various control programs, such as a "tone control processing" program (see FIG. 4), to be executed or referred to by the CPU 1. In a case where a particular control program is not prestored in the ROM 2, the particular control program may be prestored in the external storage device (e.g., hard disk device) 4, so that, by reading the control program from the external storage device 4 into the RAM 3, the CPU 1 is allowed to operate in exactly the same way as in the case where the particular control program is stored in the ROM 2. This arrangement greatly facilitates version upgrade of the control program, addition of a new control program, etc. The external storage device 4 may use any of various removable-type recording media other than the hard disk (HD), such as a flexible disk (FD), compact disk (CD-ROM or CD-RAM), magneto-optical disk (MO) and digital versatile disk (DVD); alternatively, the external storage device 4 may comprise a semiconductor memory.

The performance operator unit 5 is, for example, a keyboard including a plurality of keys operable to select pitches of tones to be generated and key switches corresponding to the keys. The performance operator unit (keyboard) 5 generates performance information for a tone performance. Namely, for each of the keys, the performance operator unit 5 generates keyboard event information, such as key-on/key-off event information and note information, in response to ON/OFF operation, by the user, of the key. It should be obvious that the performance operator unit 5 may be of any other type than the keyboard type, such as a neck-like device having tone-pitch-selecting strings provided thereon. The performance controlling operation pedal 6 is an operator operable by the user using, for example, a foot; in the instant embodiment, the pedal 6 functions as a rendition style selecting operator for selecting a release rendition style to be used for silencing a tone. The pedal 6 generates operator event information, such as pedal-on event information responsive to turning-on (pedal-on) operation by the user, pedal-off event information responsive to turning-off (pedal-off) operation by the user and a velocity value corresponding to a velocity or acceleration with which the pedal 6 is stepped on. The other operator unit 7 include various operators for changing or entering rendition style parameters, general-purpose switches, etc. The other operator unit 7 also include various other operators, such as a numeric keypad, character (text)-data entering keyboard and mouse, for selecting, setting and controlling a tone pitch, tone color, effect, etc. Note that part of the keyboard 5 may be used as operators of the other operator unit 7. The display unit 8 comprises a liquid crystal display (LCD) panel, CRT (Cathode Ray Tube) and/or the like, which displays selected rendition style parameters and controlling states of the CPU 1.

The tone generator 9, which is capable of simultaneously generating tone signals in a plurality of tone generation channels, receives performance information supplied via the communication bus 1D and synthesizes a tone on the basis of the received performance information to generate a tone signal. For example, once a key-on signal is received in response to ON (i.e., depressing) operation, by the user of a key on the keyboard 5, the tone generator 9 starts generation of a tone at a tone pitch corresponding to the depressed key. Further, once a key-off signal is received in response to OFF (i.e., releasing) operation, by the user of a key on the keyboard 5, the tone generator 9 silences a tone of a tone pitch corresponding to the released key. Also, in the instant embodiment, the tone generator 9 can silence a tone in accordance with a supplied rendition style parameter. Each tone signal generated by the tone generator 9 is subjected to predetermined digital signal processing performed by a not-shown effect circuit etc., and the tone signal having undergone the digital signal processing is supplied to a sound system 9A including an amplifier, speaker, etc. for audible generation or sounding. The tone generator 9 and sound system 9A may be constructed in any conventionally-known manner. For example, the tone generator 9 may employ any of the conventionally-known tone synthesis methods, such as the FM, PCM, physical model and formant synthesis methods. Further, the tone generator 9 may be implemented by either dedicated hardware or software processing performed by the CPU 1.

The interface 10, which is an input/output interface for communicating performance information between the electronic musical instrument and external equipment (not shown), is, for example, a MIDI interface for communicating performance information of the MIDI standard (i.e., MIDI information) between the electronic musical instrument and the external MIDI equipment or other MIDI equipment. In this case, the other MIDI equipment may be of any type (or operating type), such as the keyboard type, guitar type, wind instrument type, percussion instrument type or gesture type, as long as it can generate MIDI information in response to operation by a user of the MIDI equipment. The MIDI interface may be a general-purpose interface rather than a dedicated MIDI interface, such as RS232-C, USB (Universal Serial Bus) or IEEE1394, in which case other data than MIDI information may be communicated at the same time. In the case where a general-purpose interface as mentioned above is used as the MIDI interface, the other MIDI equipment may be arranged to transmit and receive other data than MIDI information. Also, the interface 10 may be a communication interface connected to a wired or wireless communication network (not shown), such as a LAN, Internet or telephone line network (not shown), via which the interface 10 is connected to an external server computer or the like so as to input a desired control program, various data, etc. to the electronic musical instrument. Such a communication interface may be capable of both wired and wireless communication rather than just one of wired and wireless communication.

Figure 2:
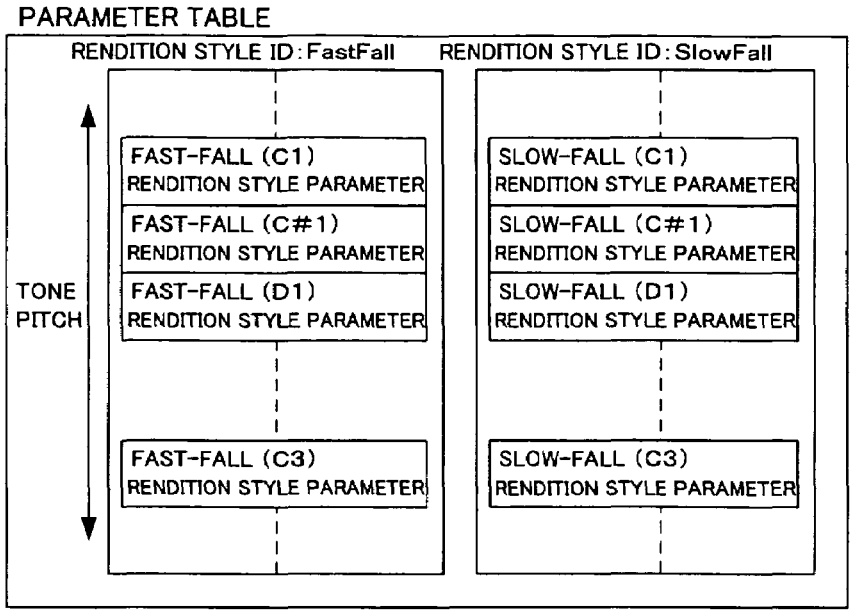
FIG. 2 is a conceptual diagram showing an example data format of a parameter table.

The following paragraphs describe the parameter table stored in the ROM 2, RAM 3, external storage device 4 or the like. FIG. 2 is a diagram conceptually showing an example data structure of the parameter table.

In order to realize a variety of release rendition styles, the parameter table is created by data basing rendition style parameters for the release rendition styles and storing the database parameters in the ROM 2, external storage device 4 or the like. As illustrated in FIG. 2, the parameter table comprises parameter sets corresponding to the various types of release rendition styles, and each of the parameter sets includes a multiplicity of rendition style parameters. Each of the parameter sets is assigned a unique rendition style ID corresponding to the type of release rendition style achievable by the rendition style parameters of that set, so that designating the rendition style ID can select the type of release rendition style. In the illustrated example, rendition style ID "FastFall" represents a parameter set for realizing a fast-fall rendition style, rendition style ID "SlowFall" represents a slow-fall rendition style, and so on. Among the various types of release rendition styles are fall rendition styles that are representative rendition styles for wind instruments. These fall rendition styles are each intended to silence (release) a tone while lowering the pitch of the tone within a short time or lowering the pitch by a gliss-down rendition. According to the length of a time for silencing the tone, the fall rendition styles are classified into the "fast-fall (FastFall)" rendition style for quickly silencing a tone without taking a long time, "slow-fall (SlowFall)" rendition style for slowly silencing a tone, "medium-fall (MediumFall)", etc. for silencing a tone within a time intermediate in length between the times for the fast-fall and short-fall rendition styles. The rendition styles can also be classified according to the difference in pitch between the start and end of the fall etc.

The parameter sets corresponding to the various types of rendition styles each comprises a plurality of rendition style parameters corresponding to various tone pitches, such as "C1", "C#1" and "D1". Namely, even in each of the rendition styles classified in the above-described manner, there are included a plurality of different variations according to the width over which to lower the pitch, pitch varying speed, performance intensity, etc. Thus, the illustrated example of FIG. 2 defines one rendition style parameter for each tone pitch under a given performance intensity. The rendition style parameters of each of the sets are tone control information defining various control parameters for reflecting a release rendition style in a tone, and they include one or more kinds of control parameters corresponding to a character of the rendition style. For example, it is only necessary for the rendition style parameters each of the sets to include at least one of control parameters, such as a volume parameter for controlling a tone volume level, pitch parameter for controlling a tone pitch, LPF or other filter value for controlling a waveform shape, original sample waveform data for realizing the release rendition style (release rendition style waveform) encoded by a desired encoding scheme selected from among the PCM (Pulse Width Modulation), DPCM (Differential PCM), ADPCM (Adaptive Differential PCM) and the like, in any one of forms of representation, such as a time-axial arrangement in which the control value varies over time and a scalar value that does not vary over time. The rendition style parameters may be prestored in memory, entered by the user as necessary, or obtained by the user modifying existing rendition style parameters as necessary. Whereas FIG. 2 illustrates an example of the parameter table where one rendition style parameter is assigned to each tone pitch, one rendition style parameter may be assigned to each of a plurality of tone pitch ranges (i.e., key ranges).

Next, a general description will be given about a first embodiment of the tone control processing performed in the electronic musical instrument of FIG. 1, with reference to FIG. 3 that is a block diagram outlining the first embodiment of the tone control processing. In the figure, arrows indicate flows of various data.

Figure 3:
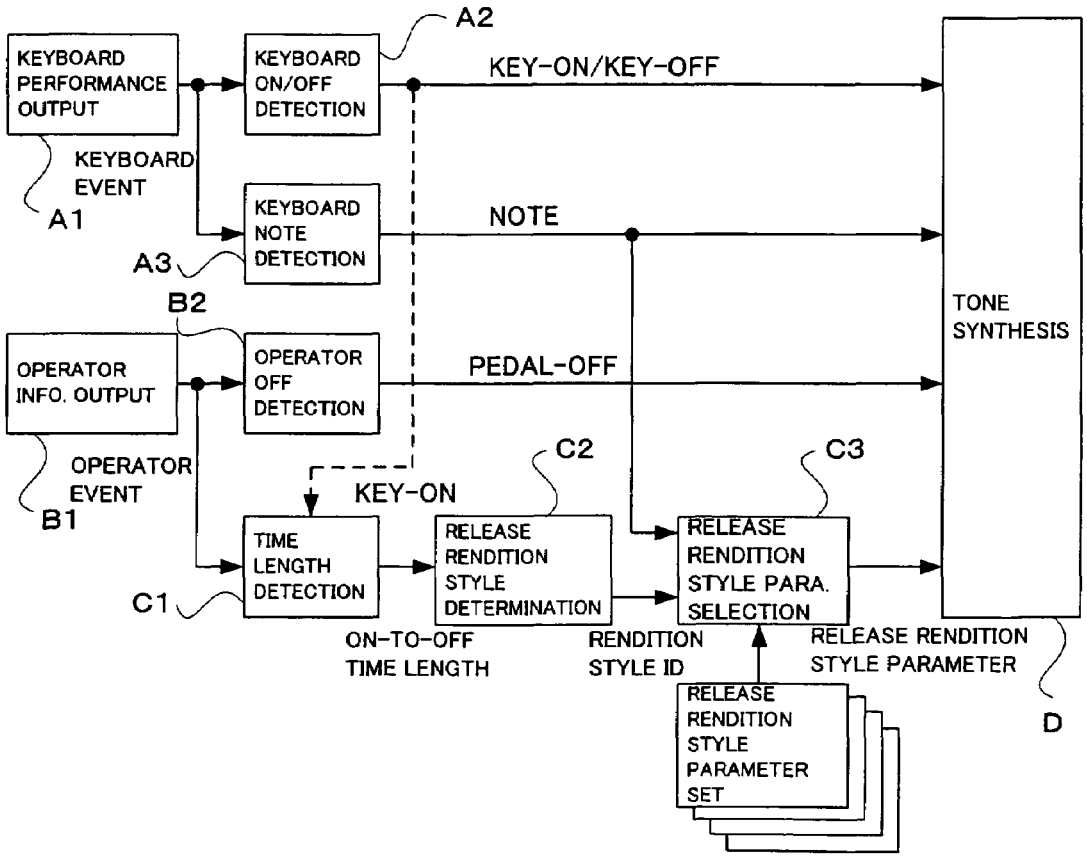
FIG. 3 is a block diagram outlining a first embodiment of tone control processing performed in the electronic musical instrument.

In FIG. 3, a keyboard performance information detection section A1 outputs, to a keyboard ON/OFF detection section A2 and keyboard note detection section A3, keyboard event information (keyboard performance information) such as information representative of a key-on or key-off event and note, generated for each of the keys in response to user's operation of the performance operator unit (e.g., keyboard) 5. The keyboard ON/OFF detection section A2 extracts the key-on or key-off event information out of the keyboard event information output from the keyboard performance information detection section A1 and supplies the extracted key-on or key-off event information to a tone synthesis section D. The keyboard note detection section A3 extracts at least the note information out of the keyboard event information output from the keyboard performance information detection section A1 and supplies the extracted note information to the tone synthesis section D and release-rendition-style parameter selection section C3. On the basis of the supplied key-on event and note information, the tone synthesis section D starts generation of a tone at the pitch corresponding to the note. Also, on the basis of the supplied key-off event and note information, the tone synthesis section D silences a tone being generated at the corresponding pitch. In this manner, tones are generated and silenced, on the basis of the key-on event, key-off event and note information generated in response to user's operation of the keyboard, in a normal or standard release state, i.e. with no release rendition style imparted thereto.

Operator information output section B1 outputs, to an operator-off detection section B2 and time length detection section C1, various operator event information (operation information), such as pedal-on event information generated in response to turning-on operation of the pedal 6 and pedal-off event information generated in response to turning-off operation of the pedal 6. The time length detection section C1 detects a predetermined ON-to-OFF time length on the basis of the pedal-on and pedal-off event information output from the operator information output section B1. Here, the "ON-to-OFF time length" means a time length from the time when the pedal 6 was turned on (i.e., turned-on time of the pedal or a time when a pedal-on event occurred) to the time when the pedal 6 was turned off (i.e., turned-off time of the pedal or a time when a pedal-off event occurred); namely, the ON-to-OFF time length represents an operation time, length of the pedal 6. The ON-to-OFF time length detected by the time length detection section C1 is supplied to a release-rendition-style determination section C2, which in turn determines, on the basis of the supplied ON-to-OFF time length, a particular rendition style ID for designating a parameter set of a release rendition style type to be used. The release-rendition-style parameter selection section C3 selects, on the basis of the determined particular rendition style ID and note information supplied from the keyboard note detection section A3, one rendition style parameter, corresponding to the note, from the parameter set of the release rendition style type corresponding to the determined rendition style ID, and it then supplies the selected rendition style parameter to the tone synthesis section D. Namely, the section C3 determines, in accordance with the input information, a rendition style parameter for realizing a release rendition style and supplies the determined rendition style parameter to the tone synthesis section D.

Operator-off detection section B2 extracts only the pedal-off event information out of the operator event information output from the operator information output section B1, and it supplies the extracted pedal-off event information to the tone synthesis section D. If the tone synthesis section D has received the pedal-off event information from the operator-off detection section B2 before receiving the key-off event information from the keyboard ON/OFF detection section A2, it silences the currently generated tone while, in accordance with the rendition style parameter selected by the release-rendition-style parameter selection section C3, reflecting the corresponding release rendition style in the tone. Namely, the tone synthesis section D has a tone generation function for starting audible generation of a tone in response to user's depressing operation of a key on the keyboard, a no-rendition-style-imparted silencing function for silencing a currently-generated tone, in response to user's releasing operation of a key on the keyboard, with a standard release without any release rendition style being imparted to the tone, and a rendition-style-imparted silencing function for silencing, in response to user's turning-off operation of the pedal 6 during a key-on period following depression of a key, the currently-generated tone while reflecting a release rendition style in the tone.

Figure 4:
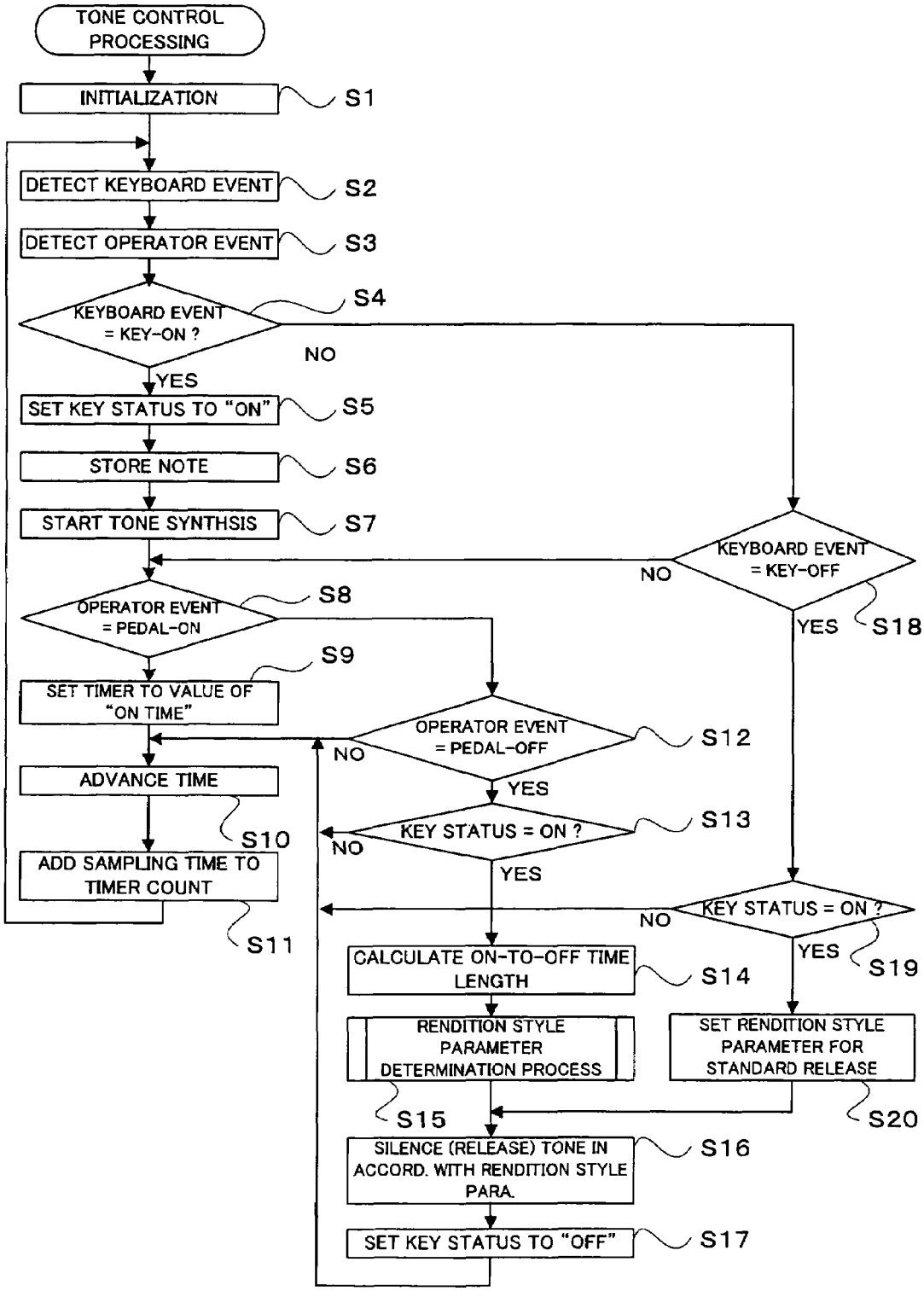
FIG. 4 is a flow chart showing an example operational sequence of the first embodiment of the tone control processing.

In the electronic musical instrument of FIG. 1, a selection is made, in response to operation of the pedal 6, of a release rendition style to be imparted from among the plurality of release rendition styles, and the silencing of the generated tone with the selected release rendition style imparted thereto is carried out by the computer executing a predetermined program (software program) for the tone control processing proposed by the present invention. FIG. 4 is a flow chart showing an example operational sequence of a first embodiment of the tone control processing.

First, at step S1, an initialization process is performed; for example, in this initialization, the timer for counting predetermined sampling times is reset to "0" (zero), a key status provided for each of the keys to determine whether an operational state of the key is to be reflected or ignored (however, only in the case of "monophonic" tone generation) is set to "OFF". The initialization process may of course include other operations. At following step S2, a detection is made of various keyboard events generated in response to user's operation of the keyboard; the various keyboard events include a key-on event generated in response to depressing operation of a key or key-off event generated in response to releasing operation of a key, and a note assigned to the operated key. At step S3, a detection is made of operator events generated in response to user's operation of the predetermined pedal 6. The operator events generated in response to user's operation of the predetermined pedal 6 include a pedal-on event generated in response to user's turning-on operation of the pedal 6 or pedal-off event generated in response to user's turning-off operation of the pedal 6, and a velocity value corresponding to a pushing (or moving) velocity or acceleration of the pedal 6.

At next step S4, a determination is made as to whether the keyboard event detected at step S2 above is a key-on event. If the keyboard event detected at step S2 is a key-on event (YES determination at step S4), the key status corresponding to the key, of which the key-on event has been detected, is set to "ON" (step S5). If the key status corresponding to the key, of which the key-on event has been detected, is set at "ON", keyboard events generated in response to operation of the key are reflected, while, if the key status is set at "OFF", keyboard events generated in response to operation of the key are ignored without being reflected. In the instant embodiment, even when a key whose key status is set at "OFF" has been released, the key-off event generated in response to the releasing operation is not reflected, and thus the tone corresponding to the releasing operation is not silenced (see steps S18-S19 to be later described). At step S6, the note information generated along with the key-on event information as the keyboard event information is stored. At step S7, synthesis of a tone is started on the basis of the key-on event information and note information, so that audible generation of the tone at the corresponding pitch is initiated. At next step S8, a determination is made as to whether the operator event detected at step S3 above is a pedal-on event. With a YES determination at step S8, the timer count is set to a value indicative of the "ON" time when the pedal-on event has occurred (step S9). This "ON" time is used to calculate the ON-to-OFF time length at step S14 as will be later described. At step S10, the time is cause to advance by the sampling time (e.g., Δt). At next time S11, the sampling time (Δt) is added to the current count of the timer. Then, the processing reverts to step S2 to repeat the operations at and after step S2.

If the operator event is not a pedal-on event as determined at step S8 (NO determination at step 8), a further determination is made at step S12 as to whether the operator event is a pedal-off event. If the operator event is a pedal-off event (YES determination at step S12), it is further determined, at step S13, whether the key status is currently set at "ON". If the operator event is not a pedal-off event (NO determination at step S12), or if the key status is not currently set at "ON" (NO determination at step S13), the processing jumps to step S10. If, on the other hand, the key status is currently set at "ON" (YES determination at step S13), the ON-to-OFF time length is calculated at step S14. In the instant embodiment, the "ON-to-OFF time length" means a time length from the time when the pedal 6 was turned on to the time when the pedal 6 was turned off. Namely, the ON-to-OFF time length is calculated by subtracting the "ON time" having been set at the turned-on time of the pedal 6 from the timer count at the turned-off time of the pedal 6 (see step S9). At step S15, a "rendition style parameter determination process" is performed on the basis of the calculated ON-to-OFF time length and stored note information (see step S6 above). In this "rendition style parameter determination process", as will be later detailed, one parameter set for a release rendition style type to be used is selected, on the basis of the ON-to-OFF time length, from the parameter table, and also one rendition style parameter is selected, on the basis of the note information, from among the multiplicity of rendition style parameters included in the selected parameter set. At step S16, the currently-generated (i.e., currently-sounding) tone is silenced in accordance with the determined rendition style parameter. At that time, control may be performed to smoothly generate a section of the tone to which the release rendition style has been connected, e.g. by generating a separate tone, corresponding to the determined rendition style parameter, from the currently-generated tone and cross-fade synthesizing these two tones. Such a waveform connection may be performed using any other method than the cross-fade synthesis. At step S17, the key status is set to "OFF". Namely, because the tone generated in response to the depressing operation of the key has already been silenced with the release rendition style, the key status is set to "OFF" so as to prevent silencing control of a tone from being performed in response to subsequent releasing operation of the key, so that the control responsive to the releasing operation of the key is disabled. Following step S17, the processing reverts to step S10.

If the keyboard event detected at step S2 is not a key-on event (NO determination at step S4), it is further determined at step S18 whether the detected keyboard event is a key-off event. If the detected keyboard event is not a key-off event (NO determination at step S18), a determination is made at step S19 as to whether the key status is currently set at "ON". If the key status is not currently set at "ON" (NO determination at step S19), the processing jumps to step S10. If on the other hand, the key status is currently set at "ON" (YES determination at step S19), then a rendition style parameter is set at step S20 for realizing a standard, default release with no rendition style imparted, and then the processing goes to step S16. Namely, if no rendition style parameter corresponding to a release rendition style has been supplied, e.g. if a normal key-off event is input with no operation of the pedal 6, a rendition style parameter is automatically set so as to silence the corresponding tome with a standard release operation.

Figure 5:
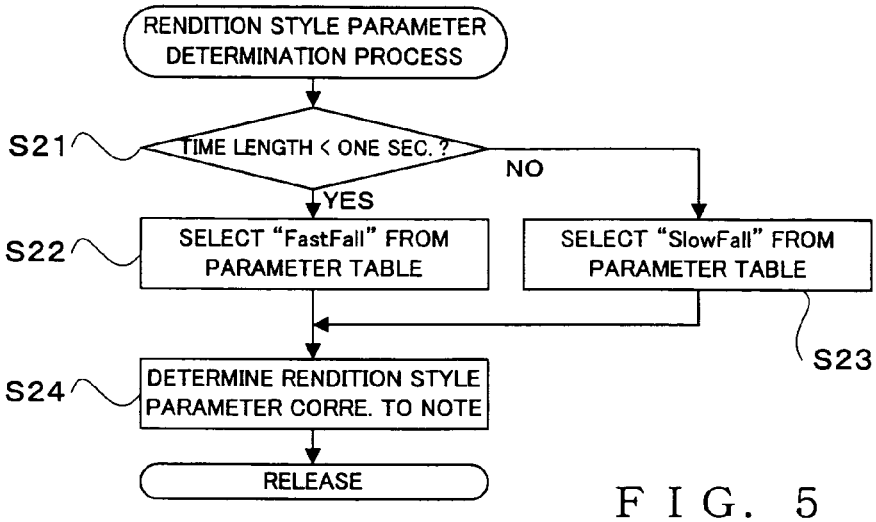
FIG. 5 is a flow chart showing an example operational sequence of a rendition style parameter determination process.

The following paragraphs describe the "rendition style parameter determination process" carried out in the above-described "tone control processing" (see step S15 of FIG. 4), with reference to FIG. 5 that is a flow chart showing an example operational sequence of the "rendition style parameter determination process".

First, at step S21, a determination is made as to whether the ON-to-OFF time length is shorter than a predetermined time (e.g., one second). If the ON-to-OFF time length is shorter than the predetermined time (YES determination at step S21), a parameter set for realizing a fast-fall rendition style with rendition style ID "FastFall" assigned thereto is selected from the parameter table (step S22). If, on the other hand, the ON-to-OFF time length is longer than the predetermined time (NO determination at step S21), a parameter set for realizing a slow-fall rendition style with rendition style ID "SlowFall" assigned thereto is selected from the parameter table (step S23). At step S24, a release rendition style to be applied is determined by selecting one rendition style parameter, corresponding to the note in question, from the selected parameter set.

Figure 6:
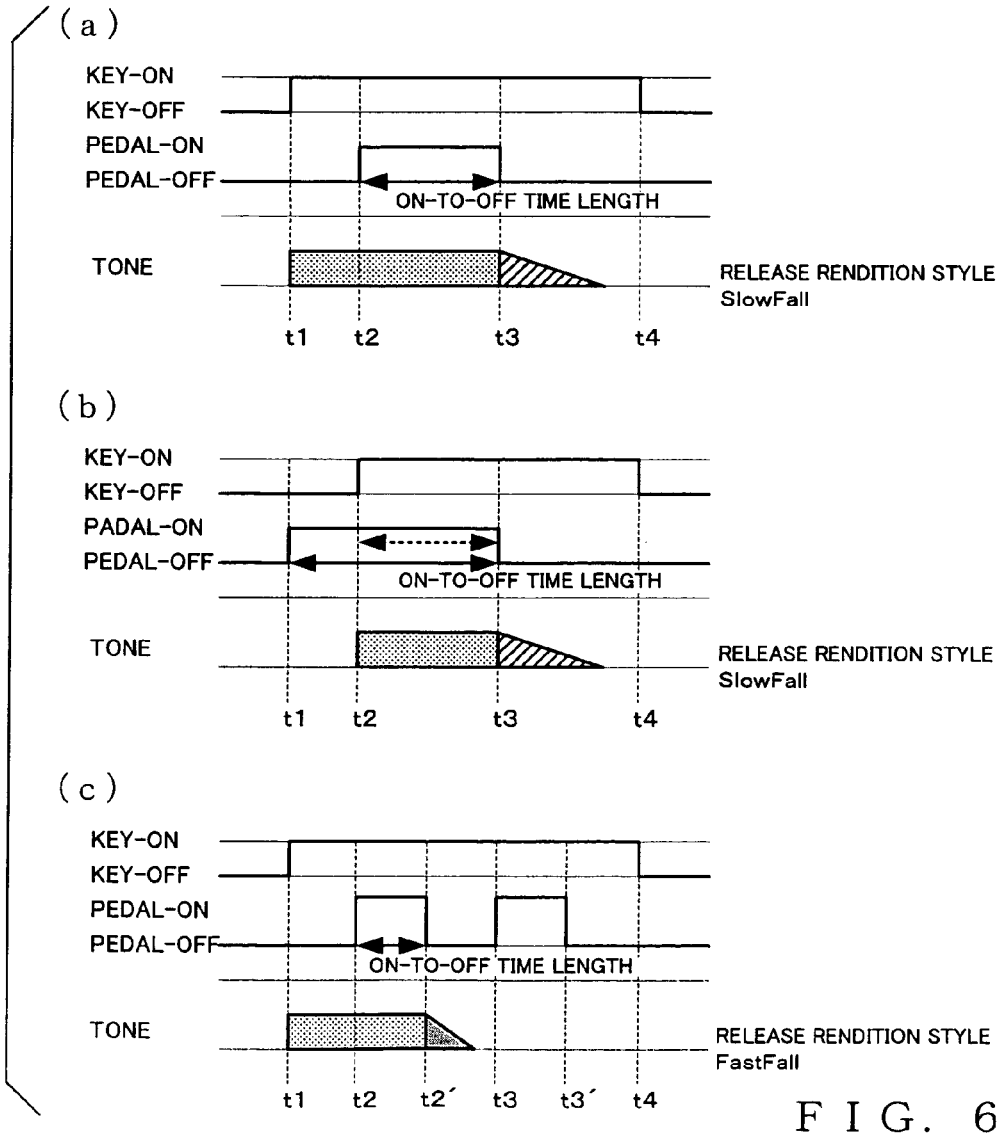
FIG. 6 is a conceptual diagram explanatory of generation control of a tone in accordance with which any one of a plurality of release rendition styles corresponding to operation of a pedal is reflected therein; section (a) shows an example of the tone generation control performed in a case where both turning-on operation and turning-off operation of the pedal is performed during a time period from depressing operation of a key to releasing operation of the key (i.e., during a key-on period), section (b) shows an example of the tone generation control performed in a case where turning-on operation of the pedal has already been performed before a key is depressed and then turning-off operation of the pedal is performed during a key-on period, and section (c) shows an example of the tone generation control performed in a case where both turning-on operation and turning-off operation of the pedal is performed repetitively more than once during a time period from depressing operation of a key to releasing operation of the key.

In the above-described manner, the user can control tones while controlling in real time a plurality of release rendition styles, by just operating the single pedal 6. Here, specific examples of tone control based on any one of the plurality of release rendition styles corresponding to operation of the pedal 6 will be described, with reference to FIG. 6 that is a conceptual diagram of generation (i.e., sounding) control of a tone reflecting in the tone any one of the plurality of release rendition styles corresponding to operation of the pedal 6. Section (a) of FIG. 6 shows an example of the tone generation control performed in a case where both turning-on operation and turning-off operation of the pedal 6 is performed during a time period from depressing operation of a key to releasing operation of the key (i.e., during a key-on period), section (b) of FIG. 6 shows an example of the tone generation control performed in a case where turning-on operation of the pedal 6 has already been performed before a key is depressed (i.e., prior to a key-on event) and then turning-off operation of the pedal 6 is performed during the key-on period, and section (c) of FIG. 6 shows an example of the tone generation control performed in a case where both turning-on operation and turning-off operation of the pedal 6 is performed repetitively more than once during a time period from depressing operation of a key to releasing operation of the key (i.e., during a key-on period). In each of the sections of FIG. 6, a timing chart indicative of key-on and key-off timing is shown in an uppermost horizontal region, a timing chart indicative of pedal-on and pedal-off timing is shown in a middle horizontal region, and an envelope shape indicative of a changing aspect of a tone is shown in a lowermost horizontal region.

In section (a) of FIG. 6, a key is depressed and a corresponding key-on event of the key is detected at time point t1, so that generation of a tone at a pitch corresponding to the note assigned to the depressed key is started at time point t1 (see step S7 of FIG. 4). In response to detection of the key-on event, the key status is set to "ON" (step S5). Once the pedal 6 is turned on and a corresponding pedal-on event is detected at time point t2, only the "ON time" is set to the value of time point t2 (step S9), so that the generation of the tone is continued as is. Then, once the pedal 6 is turned off and a corresponding pedal-off event is detected at time point t3 before the key is released, a time length between time point t3 and time point t2 is set as the ON-to-OFF time length, on the basis of which a rendition style parameter is determined (steps S12-S15). The time length between time point t3 and time point t2 is assumed to be longer than one second, and thus the currently-generated tone is silenced on the basis of the "Slow-Fall" release rendition style (step S16). Further, the key status is set to "OFF" at this point (step S17), and thus, even when the key is released and a corresponding key-off event is detected at time point t4, no silencing control of the tone responsive to the key releasing operation is performed (step S19).

In section (b) of FIG. 6, the pedal 6 is turned on and a corresponding pedal-on event is detected at time point t1 before a key is depressed on the keyboard. Thus, at this stage, only the "ON time" is set to the value of time point t1, so that generation of a tone is not started yet. Then, a key is depressed and a corresponding key-on event is detected at time point t2, so that generation of a tone at a pitch corresponding to the note assigned to the depressed key is started at time point t2. Once the pedal 6 is turned off and a corresponding pedal-off event is detected at time point t3 before the key is released, a time length between time point t3 and time point t2 is set as the ON-to-OFF time length, on the basis of which a rendition style parameter is determined. Because the time length between time point t3 and time point t2 is assumed to be longer than one second as noted above, a time length between time point t3 and time point t1 is naturally longer than one second, so that the currently-generated tone is silenced on the basis of the "SlowFall" release rendition style. In this case too, even when the key is released and a corresponding key-off event is detected at time point t4, no silencing control of the tone responsive to the key releasing operation is performed.

In section (c) of FIG. 6, a key is depressed and a corresponding key-on event is detected at time point t1, so that generation of a tone at a pitch corresponding to the note assigned to the depressed key is started at time point t1. Once the pedal 6 is turned on and a corresponding pedal-on event is detected at time point t2, only the "ON time" is set to the value of time point t2, so that the generation of the tone is continued as is. Then, once the pedal 6 is turned off and a corresponding pedal-off event is detected at time point t2' before the key is released, a time length between time point t2' and time point t2 is set as the ON-to-OFF time length, on the basis of which a rendition style parameter is determined. Here, the time length between time point t2' and time point t2 is assumed to be shorter than one second, and thus the currently-generated tone is silenced on the basis of the "FastFall" release rendition style. Further, the key status is set to "OFF" at this point. Once the pedal 6 is again turned on and a corresponding pedal-on event is detected ay time point t3, the "ON time" is set to the value of time point t3. Further, when the pedal 6 is turned off and a corresponding pedal-off event is detected at time point t3', no particular process is performed since the key status has already set to "OFF" (step S13). Namely, because the tone has already been silenced with the "FastFall" release rendition state, no tone is generated. In this case too, even when the key is released and a corresponding key-off event is detected at time point t4, no silencing control of the tone responsive to the key releasing operation is performed.

In the above-described embodiment, a time length from the time when the pedal 6 was turned on to the time when the pedal 6 was turned off is calculated as the ON-to-OFF time length, and a release rendition style to be imparted or applied is determined on the basis of the ON-to-OFF time length. In an alternative, a time length from the later one of the time when the pedal 6 was turned on (i.e., when an operator-on event was generated) and the time when a key was depressed (i.e., when a key-on event was generated) to the time when the pedal 6 was turned off may be set as the ON-to-OFF time length. In such a case, key-on event information, generated in response to the depression of the key, is output from the keyboard ON/OFF detection section A2 to the time length detection section C1 (see a dotted-line arrow of FIG. 3). Also, in this case, when the keyboard event has been determined to be a key-on event (step S4 in the "tone control processing" of FIG. 4), the key status is set to "ON" at step S5, and the current count of the timer is set as the "ON time". In this way, the time when a key was depressed (i.e., when a key-on event was generated) can be retained as the "ON time", and it is possible to calculate the ON-to-OFF time length, in the subsequent ON-to-OFF time length calculation operation (step S14), while reflecting the later one of the time when the pedal 6 was turned on and the time when a key was depressed. In such a case, the tone generated in section (b) of FIG. 6 may differ. Namely, if the time when the pedal 6 was turned on to the time when the pedal 6 was turned off is calculated as the ON-to-OFF time length, a time length from time point t3 to time point t1 represents the ON-to-OFF time length (see a solid-line arrow in section (b) of FIG. 6). If, on the other hand, the time when the key was depressed to the time when the pedal was turned off is calculated as the ON-to-OFF time length, a time length from time point t3 to time point t2 represents the ON-to-OFF time length (see a dotted-line arrow in section (b) of FIG. 6). Thus, even when the pedal 6 is turned on considerably before a key-on event, a time preceding the key-on event is not taken into account in the selection of a release rendition style, so that a release rendition style is selected in accordance with a generation start time of a tone. Therefore, even when the user has turned on the pedal 6 before a key-on event, the user can impart a more appropriate release rendition style to a generated tone by only taking into account a time from the generation start of the tone to a turned-off time of the pedal 6.

Namely, in the above-described first embodiment of the tone control apparatus, tone generation control is performed such that a tone, having started to be audibly generated on the basis of a key-on event generated in response to depressing operation of a key, is silenced on the basis of a key-off event generated in response to releasing operation of a key. Also, when the pedal 6 has been operated before the releasing operation of the key, an appropriate one of a plurality of release rendition styles is imparted to the tone, in response to the pedal operation, so as to silence the sounding tone in accordance with the release rendition style. Thus, by only operating the single pedal 6, the user can control generation of a tone while controlling in real time any one of the plurality of release rendition styles faithfully representing tone color variations specific to natural musical instruments or tone color variations based on various types of articulation. Further, the tone control apparatus, which performs the tone generation control to silence the generated tone by imparting an appropriate one of the plurality of release rendition styles, can impart a long fall-down to a release rendition style even in a performance where a time from a key-on event to a key-off event is short. Furthermore, the first embodiment of the tone control apparatus is very advantageous in that it can be extensively applied to all types of tone generators without being influenced by the types of tone generators.

Whereas the first embodiment of the tone control apparatus has been described as employing the pedal 6 as the rendition style selecting operator, the present invention is not so limited; for example, a dedicated switch may be assigned as the rendition style selecting operator, or any one of the keys on the keyboard may be assigned as the rendition style selecting operator. Namely, the rendition style selecting operator may be an ordinary panel switch or sustain pedal capable of detecting at least two values (i.e., ON and OFF values). Further, in a case where an operator, such as a volume control, which outputs an analog value, is assigned as the rendition style selecting operator, the output analog value is binaries as necessary.

Further, whereas the first embodiment of the tone control apparatus has been described as selecting either the fast-slow rendition style or the slow-slow rendition style as a type of the release rendition style, it may of course select another release-related rendition style type, such as the medium-fall rendition style, from among the plurality of release rendition styles, Furthermore, the first embodiment of the tone control apparatus has been described as setting an ON-to-OFF time of the pedal 6 as the operating time length and selecting a release rendition style on the basis of the operating time length of the pedal 6, the present invention is not so limited; for example, an ON-to-ON time, OFF-to-OFF time or any other suitably-measured time interval of the pedal 6 or other operator 7 may be set as the operating time length, and a release rendition style on the basis of the operating time length.

Furthermore, although the first embodiment of the tone control apparatus has been described in relation to the case where a selected release rendition style is merely imparted to a generated tone to silence the tone, the present invention is not so limited; of course, a plurality of release rendition styles may be imparted, in response to operation of the pedal, to a series of tones when these successive tones are to be silenced.

In the case where the polyphonic tone generation is employed, a same release rendition style may be imparted compulsorily to all currently-generated tones, in response to turning-off of the pedal, so as to silence all of the currently-generated tones. In the case where the monophonic tone generation with a single output track is employed such that tones are generated at pitches corresponding to sequentially-generated note information, the tone pitch to be sounded is replaced with a note of each newly-generated keyboard event information and the note at the time of turning-off of the pedal may be imparted with a release rendition style to silence the tone.

Next, a description will be made about the second embodiment of the present invention. The tone control apparatus in accordance with the second embodiment of the present invention performs generation control of individual tones such that a tone, having started to be generated in response to turning-on (depressing) operation of the keyboard (performance operator unit) is silenced (released) while being imparted with an appropriate release rendition style selected from among a plurality of different release rendition styles, or that audible generation (or sounding) of a tone is started with an appropriate attack rendition style selected from among a plurality of different attack rendition styles. In the second embodiment of the tone control apparatus too, the general hardware setup as shown in FIG. 1 is employed, and the computer included therein is constructed to execute a predetermined software program directed to a second embodiment of the tone control processing. Of course, the second embodiment of the tone control processing too may be implemented by other than a software program, such as a dedicated hardware apparatus that includes discrete circuits or integrated or large-scale integrated circuitry built therein. Further, the equipment to which is applied the tone control apparatus of the present invention may be other than an electronic musical instrument, such as an automatic performance apparatus like a sequencer, karaoke apparatus, electronic game apparatus or other type of multimedia-related device, personal computer or any other desired form of product.

First, only differences of the second embodiment of the tone control apparatus from the first embodiment of the tone control apparatus will be briefed below. Various processing performed by the CPU 1 in the second embodiment include "tone control processing for a release" (see FIG. 8 to be later described) for performing control to silence a tone, having started to be generated in response to keyboard operation, by imparting thereto any one of release rendition styles, specific to various musical instruments and intended to realize more natural and realistic performances, in response to user's operation of the single predetermined pedal 6, "tone control processing for an attack" (see FIG. 12 to be later described) for performing control to start audible generation of a stone in response to user's operation of the keyboard by imparting thereto any one of attack rendition styles specific to various musical instruments, etc. The external storage device 4 stores therein parameter tables (see FIG. 2) which, in this embodiment, contains a multiplicity of rendition style parameters that are tone control information for realizing release (or attack) rendition styles specific to various musical instruments, various data, such as tone waveform data prepared for various tone colors like piano tones, and various control programs, such as those for the "tone control processing for a release" (see FIG. 8) and for the "tone control processing for an attack" (see FIG. 12). In the second embodiment, the pedal 6 functions not only as a rendition style selecting operator for selecting a release rendition style to be used for silencing of a tone, but also as a rendition style selecting operator for selecting an attack rendition style to be used for audibly generating a tone. For control of a tone generated by the tone generator 9, the second embodiment can not only silence a tone with a release rendition style according to an input rendition style parameter, but also start generation of a tone with an attack rendition style according to an input rendition style parameter.

In the second embodiment, the parameter tables stored in the ROM 2, RAM 3, external storage device 4 or the like are of generally the same data format as shown in FIG. 2. Specifically, although FIG. 2 shows only the parameter table of release rendition styles, the second embodiment also includes a parameter table of attack rendition styles provided in the same data format as the parameter table of release rendition styles. Note that the parameters related to the release rendition styles and attack rendition styles may be either mixedly included in the same parameter table or included in separate parameter tables as noted above. Namely, in the second embodiment, the parameter tables are provided by storing, in the ROM 2, external storage device 4 or the like, a database of rendition style parameters for realizing the individual release rendition styles and attack rendition styles, in order to realize a variety of release rendition styles and attack rendition styles.

Figure 7:
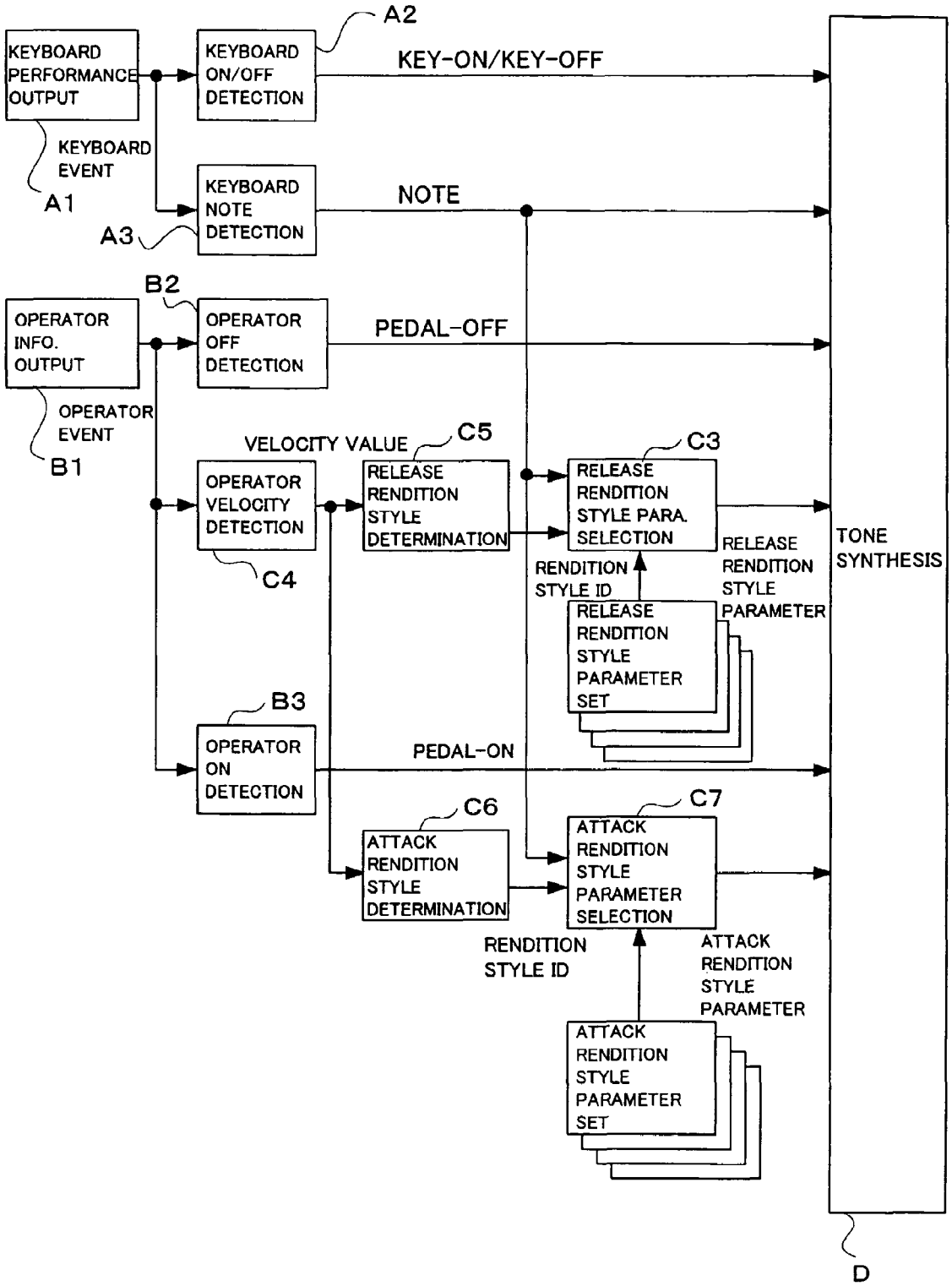
FIG. 7 is a block diagram outlining a second embodiment of the tone control processing performed in a second embodiment of the tone control apparatus.

Next, a description will be given about the second embodiment of the tone control processing performed in the electronic musical instrument of FIG. 1, with reference to FIG. 7. FIG. 7 is a block diagram similar to FIG. 3, and the following paragraphs describe only features specific to the second embodiment with a description of the same functions as in FIG. 3 omitted.

First, a general outline is given about the tone control processing for impartment of a release rendition style. In FIG. 7, an operator velocity detection section C4 detects, on the basis of operator event information output from an operator information output section B1, an ON velocity value or an OFF velocity value corresponding to a velocity or acceleration with which the pedal 6 is turned on (i.e., pushed or stepped on) or turned off. Velocity value detected by the operator velocity detection section C4 is supplied to a release rendition style determination section C5, which in turn determines, on the basis of the velocity value, a rendition style ID for designating a release rendition style to be used. In generally the same manner as noted above, a release rendition style parameter selection section C3 selects, on the basis of the determined rendition style ID and note information supplied from the keyboard note detection section A3, one rendition style parameter from the parameter set of the release rendition style type corresponding to the determined rendition style ID, and it then supplies the selected rendition style parameter to the tone synthesis section D. Silencing function performed by the tone synthesis section D in accordance with the release rendition style parameter from the release rendition style parameter selection section C3 is generally the same as described above.

Next, a general outline is given about the tone control processing for impartment of an attack rendition style. In FIG. 7, an attack rendition style determination C6 determines a rendition style ID on the basis of the velocity value output from the operator velocity detection section C4. Attack rendition style parameter selection section C7 selects one rendition style parameter, corresponding to note information output from the keyboard note detection section A3, from the parameter set of the attack rendition style type corresponding to the determined rendition style ID, and it then supplies the selected rendition style parameter to the tone synthesis section D. Operator-ON detection section B3 extracts only pedal-on event information out of the operator event information from the operator information output section B1 and supplies the extracted pedal-on event information to the tone synthesis section D. If the tone synthesis section D has received the pedal-on event information from the operator-ON detection section B3 prior to receipt of the key-on event information from the keyboard ON/OFF detection section A2, it starts audible generation of a tone while reflecting, in the tone, the corresponding attack rendition style in accordance with the received attack rendition style parameter. If, on the other hand, the tone synthesis section D has received the key-on event information from the keyboard ON/OFF detection section A2 prior to receipt of the pedal-on event information from the operator-ON detection section B3, then it starts audible generation of the tone with a standard attack, i.e. with no attack rendition style imparted to the tone.

Figure 8:
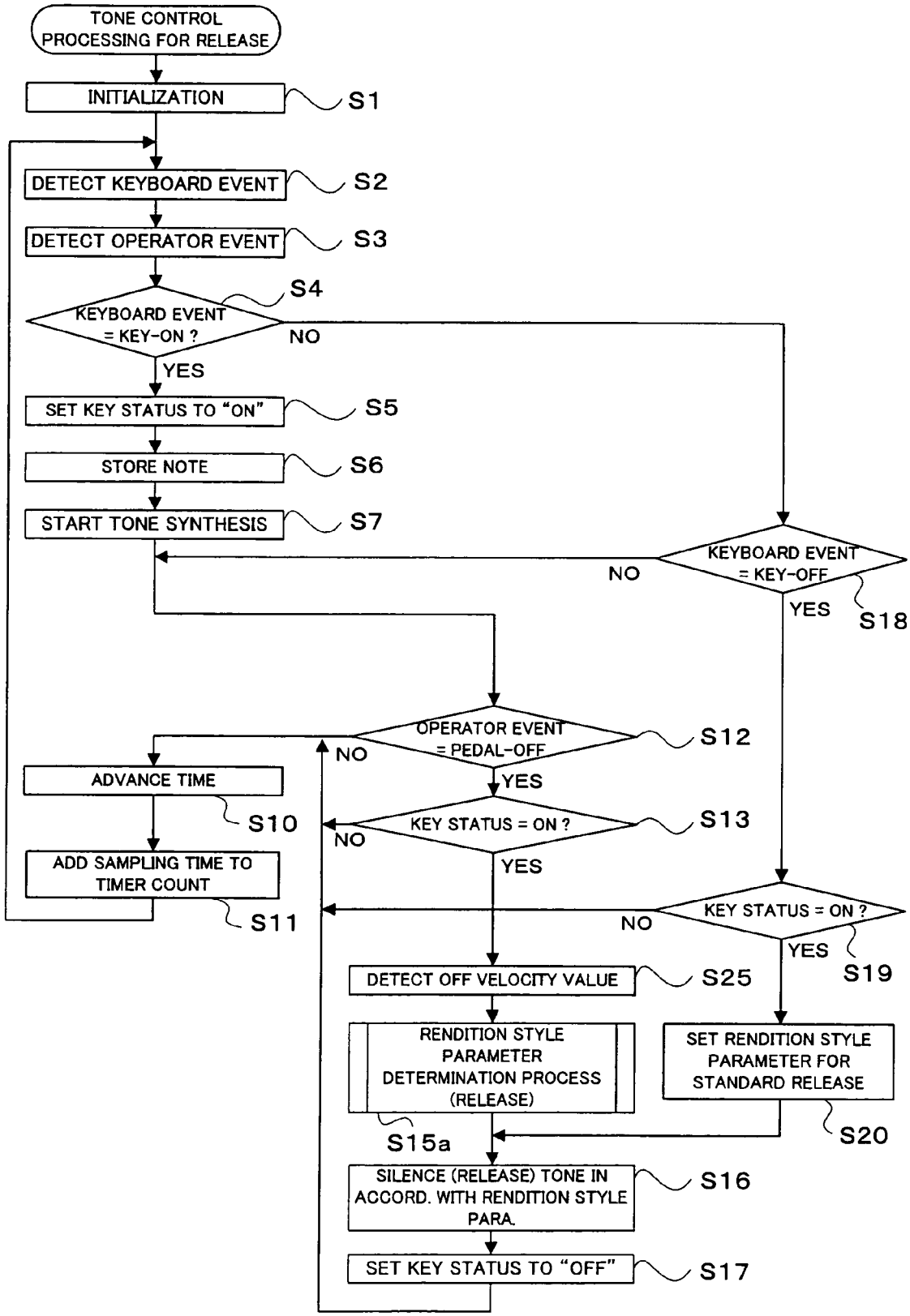
FIG. 8 is a flow chart showing an embodiment of tone control processing for a release performed in the second embodiment of the tone control apparatus.

The following paragraphs describe an example of the tone control processing for a release rendition style carried out in the second embodiment, with reference to a flow chart of FIG. 8. FIG. 8 shows an example operational sequence in which a release rendition style is selected on the basis of an OFF velocity value corresponding to turning-off operation of the pedal 6. In FIG. 8, steps of the same step numbers as in FIG. 4 are directed to the same operations as in FIG. 4; therefore, these steps will not be described here to avoid unnecessary duplication, and only steps different from FIG. 4 will be described. Briefly speaking, in FIG. 8, steps S8 and S9 of FIG. 4 are omitted, and step S14 of FIG. 4 is replaced with step S25.

When an operator event has been detected, the processing of FIG. 8 goes, from step S7, to step S12 in response to a NO determination at step S18. At step S12, a determination is made as to whether the operator event detected at step S3 is a pedal-off event. If the operator event is a pedal-off event (YES determination at step S12), it is further determined, at step S13, whether the key status is currently set at "ON". If the operator event is not a pedal-off state (NO determination at step S12), or if the key status is not currently set at "ON" (NO determination at step S13), the processing jumps to step S10. At step S10, as noted earlier, the time is cause to advance by the sampling time (e.g., Δt). At next time S11, the sampling time (Δt) is added to the current count of the timer. Then, the processing reverts to step S2 to repeat the operations at and after step S2.

If, on the other hand, the key status is currently set at "ON" (YES determination at step S13), an OFF velocity value is detected at step S25; this OFF velocity value is detected, for example, from a moving velocity, acceleration, etc. of the pedal 6 when the pedal 6 has been turned off. "rendition style parameter determination process for a release" is performed at step S15*a* on the basis of the detected OFF velocity value and stored note information (see step S6 above). In this "rendition style parameter determination process for a release", as will be later detailed, one parameter set of a release rendition style type to be used is determined, on the basis of the OFF velocity value, from the parameter table, and also one rendition style parameter is selected, on the basis of the note information, from among a multiplicity of rendition style parameters included in the selected parameter set. Then, an operation of step S16 is performed in the same manner as at step S16 of FIG. 4.

Figure 9:
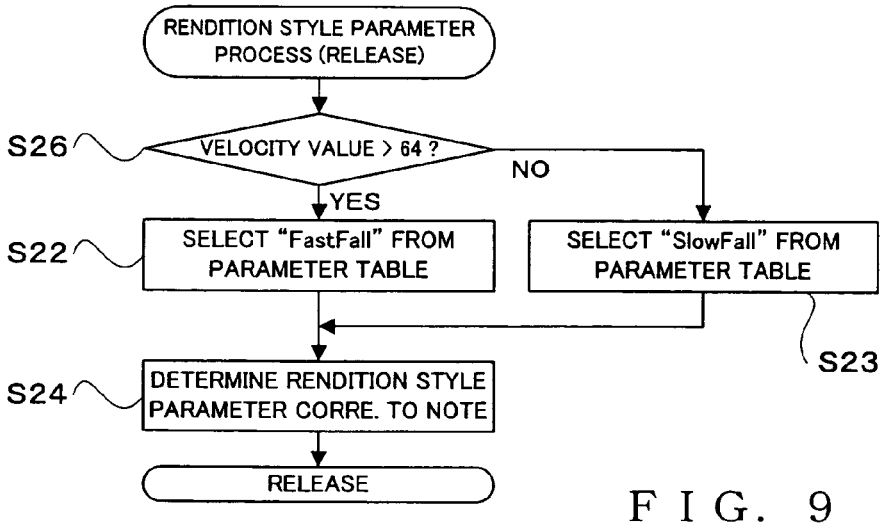
FIG. 9 is a flow chart showing an example operational sequence of a rendition style parameter determination process for a release.

The following paragraphs describe the "rendition style parameter determination process for a release" carried out in the above-described "tone control processing for a release" (see step S15*a* of FIG. 8), with reference to FIG. 9 that is a flow chart showing an example operational sequence of the "rendition style parameter determination process for a release" carried out at see step S15*a* of FIG. 8. In FIG. 9, steps of the same step numbers as in FIG. 5 are directed to the same operations as in FIG. 5; therefore, these steps will not be described here to avoid unnecessary duplication, and only steps different from FIG. 5 will be described. Briefly speaking, in FIG. 9, step S21 of FIG. 5 is replaced with step S26.

First, at step S26, a determination is made as to whether or not the velocity value (OFF velocity value in this case) is greater than a predetermined value (e.g., 64). If the velocity value (OFF velocity value in this case) is greater than the predetermined value "64" (YES determination at step S26), then the process goes to step S22, where, in the same manner as noted earlier, a parameter set for realizing a fast-fall rendition style with rendition style ID "FastFall" assigned thereto is selected from the parameter table (step S22). If, on the other hand, the velocity value (OFF velocity value in this case) is smaller than the predetermined value (NO determination at step S26), the process goes to step S23, where, in the same manner as noted earlier, a parameter set for realizing a slow-fall rendition style with rendition style ID "SlowFall" assigned thereto is selected from the parameter table (step S23).

Whereas the "tone control processing for a release" has been described above as selecting a rendition style parameter on the basis of an OFF velocity value corresponding to turning-off operation of the pedal 6, the selection of a rendition style parameter may be made on the basis of an ON velocity value corresponding to turning-on operation of the pedal 6. In such a case, the "tone control processing for a release" is modified in such a manner that step S12 determines whether the operator event detected at step S3 is a pedal-on event, step S25 detects an ON velocity value and step S26 determines whether or not the ON velocity value is greater than a predetermined value.

Figure 10:
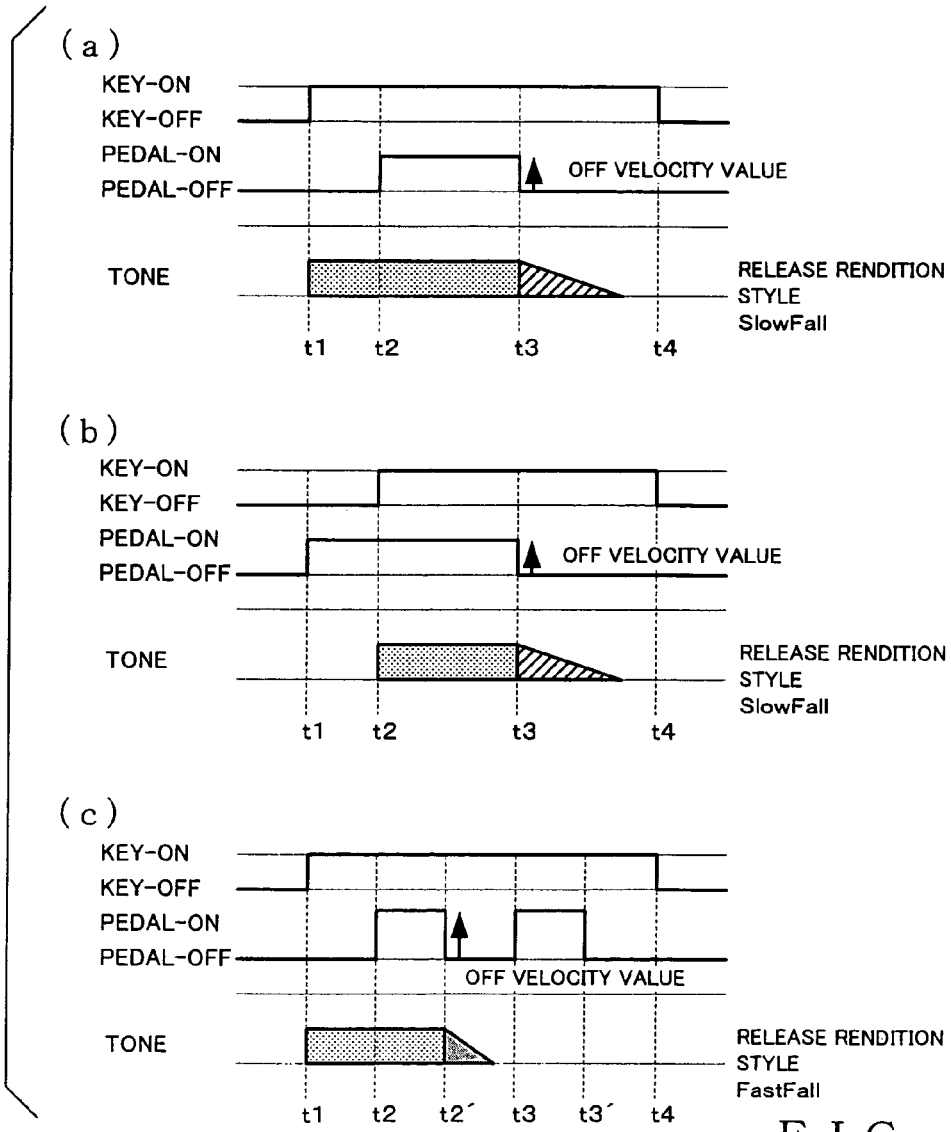
FIG. 10 is a conceptual diagram explanatory of generation control of a tone reflecting therein any one of a plurality of release rendition styles based on turning-off operation of the pedal.
Figure 11:
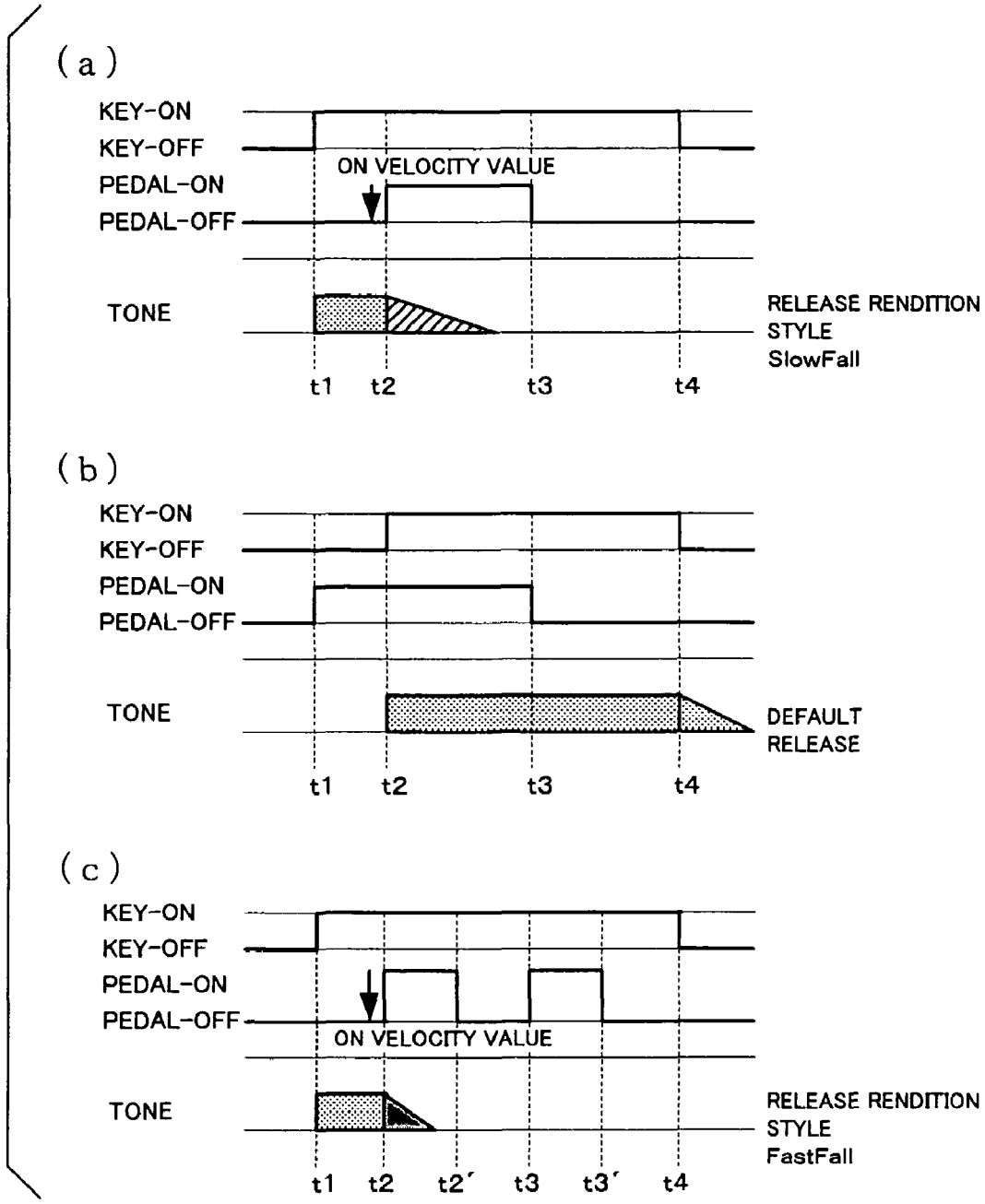
FIG. 11 is a conceptual diagram explanatory of generation control of a tone reflecting therein any one of a plurality of release rendition styles based on turning-on operation of the pedal.

In the above-described manner, the user can control tones while controlling in real time a plurality of release rendition styles, by just operating the single pedal 6 with appropriately-adjusted forces. Here, specific examples of generation control of tones based on a plurality of release rendition styles corresponding to operation of the pedal 6 will be described, with reference to FIG. 10 that is a conceptual diagram explanatory of generation (i.e., sounding) control of a tone reflecting in the tone any one of a plurality of release rendition styles responsive to turning-off operation of the pedal 6. FIG. 10 conceptually shows various examples of the tone generation control performed in response to turning-off operation similar to that of FIG. 6. FIG. 11 is a conceptual diagram explanatory of generation control of a tone reflecting in the tone any one of a plurality of release rendition styles corresponding to turning-on operation of the pedal 6. In each of FIGS. 10 and 11, section (a) shows an example of the tone generation control performed in a case where both turning-on operation and turning-off operation of the pedal 6 is performed during a time period from depressing operation of a key to releasing operation of the key (i.e., during a key-on period of the key), section (b) shows an example of the tone generation control performed in a case where turning-on operation of the pedal 6 has already been performed before a key is depressed (i.e., prior to a key-on event) and then turning-off operation of the pedal 6 is performed during the key-on period, and section (c) shows an example of the tone generation control performed in a case where both turning-on operation and turning-off operation of the pedal 6 is performed repetitively more than once during a time period from depressing operation of a key to releasing operation of the key (i.e., during a key-on period of the key). In each of sections (a)-(c) in FIGS. 10 and 11, as in FIG. 6, a timing chart indicative of key-on and key-off timing is shown in an uppermost horizontal region, a timing chart indicative of pedal-on and pedal-off timing is shown in a middle horizontal region, and an envelope shape indicative of a changing aspect of a tone is shown in a lowermost horizontal region. For convenience of explanation, event generation timing of each velocity value is indicated by an arrow.

Now, the various examples of the tone generation control based on turning-off operation of the pedal 6, illustratively shown in FIG. 10, are described only with respect to differences from the examples of the tone generation control illustrated in FIG. 6. Once the pedal 6 is turned off and a corresponding pedal-off event is detected at time point t3 before a key is released, an OFF velocity value corresponding to the turning-off operation of the pedal 6 is detected, and then a rendition style parameter is determined on the basis of the detected OFF velocity value (steps S12, S13 and S15*a* of FIG. 8). Here, the OFF velocity value is assumed to be smaller than 64, and thus the currently-generated tone is silenced on the basis of the "SlowFall" release rendition style (step S16).

In section (b) of FIG. 10, once the pedal 6 is turned off and a corresponding pedal-off event is detected at time point t3 before a key is released, a rendition style parameter is determined on the basis of the detected OFF velocity value. In this example too, the OFF velocity value is assumed to be smaller than 64, and thus the currently-generated tone is silenced on the basis of the "SlowFall" release rendition style In section (c) of FIG. 10, once the pedal 6 is turned off and a corresponding pedal-off event is detected at time point t2' before the key is released, a rendition style parameter is determined on the basis of the detected OFF velocity value. In this example, the OFF velocity value is assumed to be greater than 64, and thus the currently-generated tone is silenced on the basis of the "FastFall" release rendition style. Further, the key status is already set at "OFF" at this point, and thus, even when the pedal 6 is again turned on at time point t3 and then turned off at time point t3', only the time is caused to advance. However, because the tone has already been silenced in accordance with the "FastFall" release rendition style, no tone is being generated at this point although the key is in a depressed (or key-on) state. Even when the key is released and a corresponding key-off event is detected at time point t4, no silencing control of the tone responsive to the key releasing operation is performed.

Next, the tone generation control based on turning-on operation of the pedal 6 will be described below, with reference to FIG. 11. As seen from section (a) of FIG. 11, audible generation of a tone is started as a key is depressed at time point t1. Once the pedal 6 is turned on and a corresponding pedal-on event is detected at time point t2, an ON velocity value corresponding to the turning-on operation of the pedal 6 is detected, and a rendition style parameter is determined on the basis of the detected ON velocity value. Here, the ON velocity value is assumed to be smaller than 64, and thus the currently-generated tone is silenced on the basis of the "SlowFall" release rendition style. Even when the key is released and a corresponding key-off event is detected at time point t4, no silencing control of the tone responsive to the key releasing operation is performed.

As seen from section (b) of FIG. 11, when the pedal 6 is turned on and a corresponding pedal-on event is detected at time point t1, no key has not yet been depressed, and thus generation of a tone is started yet at time point t1. In this case, no ON velocity value is detected. As a key is depressed at time point t2, generation of a corresponding tone is started at time point t2. When the pedal 6 is turned off and a corresponding pedal-off event is detected at time point t3 before the key is depressed, the generation of the tone is continued as is. Then, once the key is released at time point t4, the tone is silenced by default in response to the releasing operation of the key. In this instance, the tone continues to be generated for a time period from the key-on event to the key-off event, and the tone is silenced with a standard release, i.e. with no release rendition style corresponding to the pedal operation being selected. This control is the same as the ordinary tone generation control based only on operation of a key (i.e., with no operation of the pedal 6 involved).

Referring to section (c) of FIG. 11, as a key is depressed at time point t1, generation of a corresponding tone is started at time point t1. When the pedal 6 is turned on and a corresponding pedal-on event is detected at time point t2, an ON velocity value corresponding to the turning-on operation of the pedal 6 is detected, and a rendition style parameter is determined on the basis of the detected ON velocity value. In this example, the ON velocity value is assumed to be greater than 64, and the currently-generated to is silenced on the basis of the "FastFall" release rendition style. Even when the pedal 6 is again turned on at time point t3, only the time is caused to advance. However, because the tone has already been silenced in accordance with the "FastFall" release rendition style, no tone is being generated at this point although the key is in the depressed (or key-on) state. Even when the key is released and a corresponding key-off event is detected at time point t4, no silencing control of the tone responsive to the key releasing operation is performed.

Figure 12:
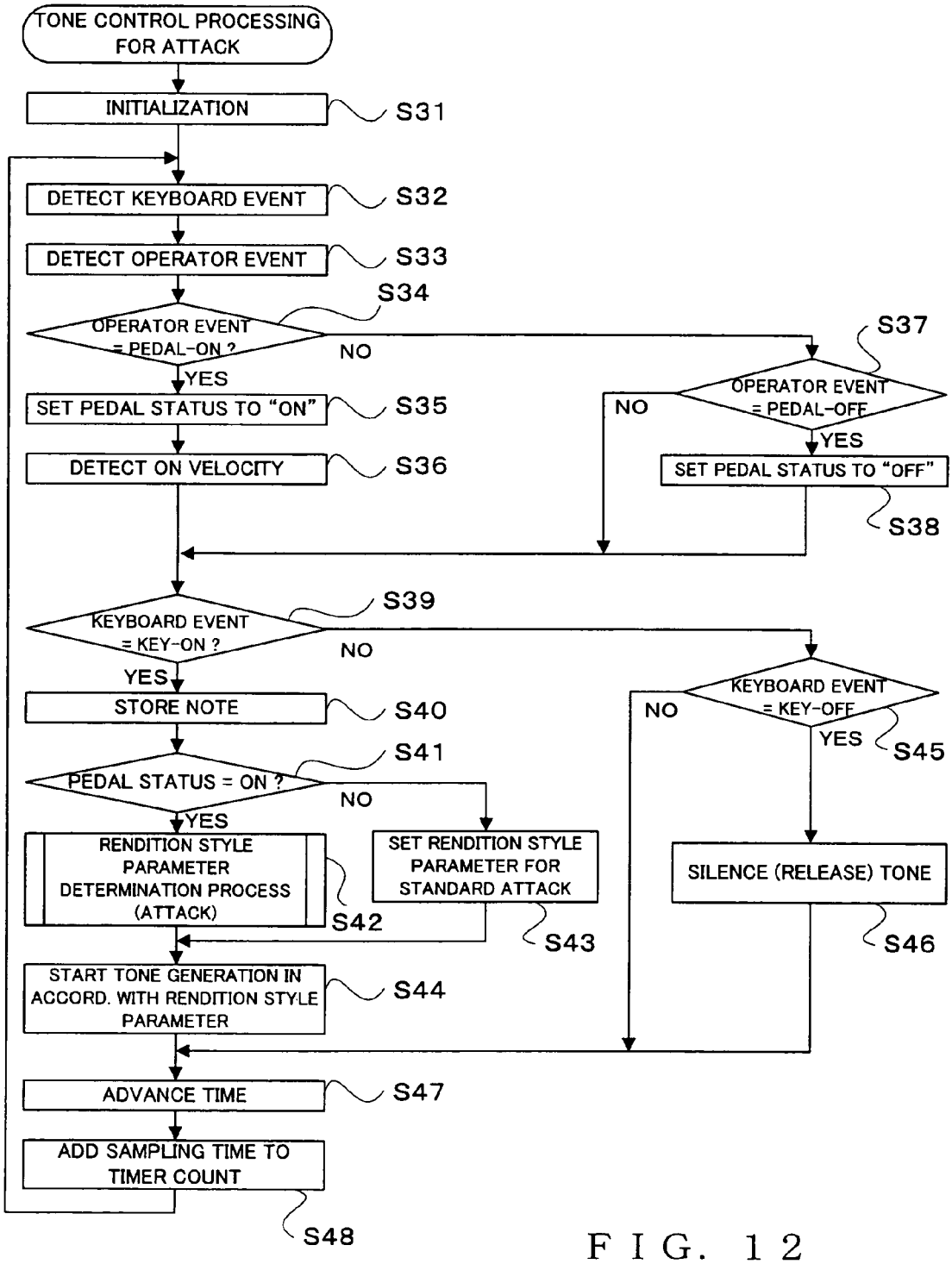
FIG. 12 is a flow chart showing an example operational sequence of a rendition style parameter determination process for an attack performed in the second embodiment.

The following paragraphs describe the "tone control processing for an attack" for selecting, from among a plurality of attack rendition styles, an attack rendition style to be imparted in response to operation of the pedal 6 and starting audible generation of a tone with the selected attack rendition styles imparted thereto. FIG. 12 is a flow chart showing an example operational sequence of the "tone control processing for an attack".

First, at step S31, an initialization process is performed; for example, in this initialization, the timer for counting predetermined sampling times is reset to "0" (zero), a pedal status provided for determining whether an operational state of the pedal is to be reflected or ignored is set to "OFF". At following step S32, a detection is made of various keyboard events generated in response to user's operation of the keyboard. At step S33, a detection is made of an operator event generated in response to user's operation of the predetermined pedal 6. At next step S34, a determination is made as to whether the detected operator event is a pedal-on event. If the detected operator event is a pedal-on event (YES determination at step S34), the pedal status is set to "ON" (step S35). At next step S36, an ON velocity value is detected; this ON velocity value is detected, for example, on the basis of a moving (pushing) velocity, acceleration, etc. of the pedal 6 when the pedal 6 has been turned on. If, on the other hand, the detected operator event is not a pedal-ff event but a pedal-on event (NO determination at step S34 and YES determination at step S37), the pedal status is set to "OFF" (step S38). When the pedal status is set at "ON", the operator event generated by user's operation of the pedal 6 is reflected, while, when the pedal status is set at "OFF", the operator event generated by user's operation of the pedal 6 is ignored without being reflected.

At next step S39, a determination is made as to whether the detected keyboard event is a key-on event. If the detected keyboard event has been determined to be a key-on event (YES determination at step S39), the note information generated along with the key-on event information as the keyboard event information is stored at step S40. At step S41, it is determined whether the pedal status is currently set at "ON". If the pedal status is currently set at "ON" (YES determination at step S41), a "rendition style parameter determination process for an attack" is performed at step S42. The "rendition style parameter determination process for an attack" may be one obtained by appropriately modifying the rendition style parameter determination process for a release of FIG. 5 so as to select, at steps S22 and S23, a rendition style ID related to an attack rendition style; namely, in the rendition style parameter determination process for an attack, a rendition style ID associated with an attack rendition style type is selected as the rendition style ID. In this way, one parameter set of an attack rendition style type to be used is selected, on the basis of the ON velocity value, from the parameter table, and also one rendition style parameter is selected, on the basis of the note information, from among a multiplicity of rendition style parameters included in the selected parameter set.

If the pedal status is not currently set at "ON" (NO determination at step S41), then a rendition style parameter for realizing a standard, default attack with no rendition style imparted thereto is set at step S43, and then the process moves on to step S44. Namely, when no rendition style parameter corresponding to an attack rendition style has been given, e.g. when normal key-on even information has been input with no pedal operation involved, a rendition style parameter is set such that audible generation of a tone is started with a standard attack. At following step S44, generation of a tone is started in accordance with the determined rendition style parameter. If the detected keyboard event is not a key-on event but a key-off event (NO determination at step S39 and YES determination at step S45), then the tone is silenced at step S46. At step S47, the time is cause to advance by the sampling time (e.g., $\Delta t$). At next time S48, the sampling time ($\Delta t$) is added to the current count of the timer.

Figure 13:
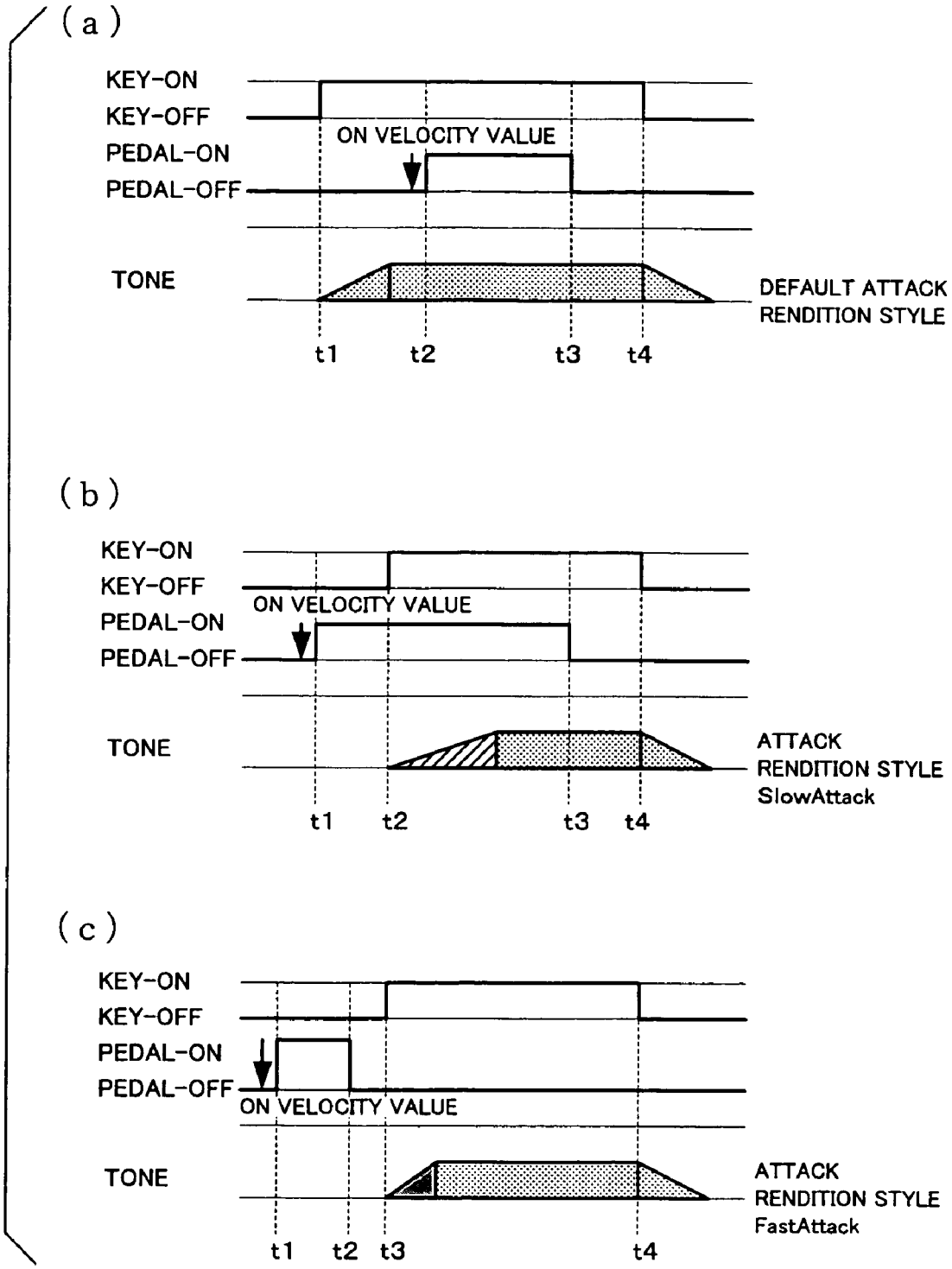
FIG. 13 is a conceptual diagram explanatory of generation control of a tone reflecting therein any one of a plurality of attack rendition styles based on turning-on operation of the pedal.

In the above-described manner, the user can control tones while controlling in real time a plurality of attack rendition styles, by just operating the single pedal 6. Here, specific examples of tone control based on a plurality of attack rendition styles corresponding to operation of the pedal 6 will be described, with reference to FIG. 13 that is a conceptual diagram of generation (i.e., sounding) control of a tone reflecting in the tone any one of the plurality of attack rendition styles corresponding to operation of the pedal 6. Sections (a)-(c) of FIG. 13 are similar to sections (a)-(c) of FIGS. 10 and 11. Note, however, that section (c) of FIG. 13 shows an example of the tone control performed when both turning-on operation and turning-off operation has been performed before a key is depressed (i.e., prior to a key-on event).

As seen from section (a) of FIG. 13, once a key is depressed at time point t1 prior to turning-on operation of the pedal 6, generation of a tone is started with a default attack rendition style. Once the pedal 6 is turned on and a corresponding pedal-on event is detected at time point t2, an ON velocity value corresponding to the turning-on operation of the pedal 6 is detected, and, in this case, the tone continues to be generated as is without a rendition style parameter being selected on the basis of the detected ON velocity value. Then, the tone is silenced in response to releasing operation of the key at time point t4. Namely, in this case, generation of the tone is started with the standard attack without any attack rendition style corresponding to the pedal operation being selected.

As seen from section (b) of FIG. 13, when the pedal 6 is turned on and a corresponding pedal-on event is detected at time point t1, no key has not yet been depressed at time point t1 because the pedal operation at this point is turning-on operation before depression of a key), and thus generation of a tone is not started at time point t1. Then, an ON velocity value corresponding to the turning-on operation of the pedal 6 is detected. As a key is depressed at time point t2, generation of a corresponding tone is started at time point t2. Because the pedal 6 has already been turned on by that time, and a rendition style parameter is determined on the basis of the detected ON velocity value. Here, the ON velocity value is assumed to be smaller than 64, and thus generation of the tone has been started on the basis of the "SlowAttack" release rendition style. Then, once the key is released at time point t4, the tone is silenced in response to the releasing operation of the key. In this instance, the tone continues to be generated for a time period from the key-on event to the key-off event, and the tone is silenced with a standard release, i.e. with no release rendition style corresponding to the pedal operation being selected. This control is the same as the ordinary tone generation control based only on operation of a key (i.e., with no operation of the pedal 6 involved).

As can be seen from section (c) of FIG. 13, generation of a tone is not started yet at time point t1 in this case too. Then, an ON velocity value corresponding to the turning-on operation of the pedal 6 is detected. As a key is depressed at time point t3, generation of a corresponding tone is started at time point t3. Because the pedal 6 has already been turned on by that time, a rendition style parameter is determined on the basis of the detected ON velocity value. Here, the ON velocity value is assumed to be greater than 64, and thus generation of the tone has been started on the basis of the "FastAttack" release rendition style. Then, once the key is released at time point t4, the tone is silenced in response to the releasing operation of the key.

Namely, in the above-described second embodiment of the tone control apparatus, tone generation control is performed such that a tone, audibly generated on the basis of a key-on event generated in response to depressing operation of a key, is silenced on the basis of a key-off event generated in response to releasing operation of a key. Also, when the pedal 6 has been operated before the releasing operation of the key, an appropriate one of a plurality of release rendition styles is imparted to the tone, in response to the pedal operation, so as to silence the sounding tone by imparting the release rendition style to the tone. Further, when the pedal 6 has been operated before depressing operation of a key, audible generation of a tone is started with an appropriate one of a plurality of attack rendition styles imparted to the tone. Thus, by only operating the single pedal 6, the user can control generation of tones while controlling in real time a plurality of release or attack rendition styles faithfully representing tone color variations specific to natural musical instruments or tone color variations based on various types of articulation. Further, the tone control apparatus of the present invention is very advantageous in that it can be extensively applied to all types of tone generators without being influenced by the types of tone generators.

Whereas the second embodiment of the tone control apparatus too has been described as employing the pedal 6 as the rendition style selecting operator, the present invention is not so limited; for example, a dedicated switch may be assigned as the rendition style selecting operator, or any one of the keys on the keyboard may be assigned as the rendition style selecting operator.

Further, whereas the second embodiment of the tone control apparatus has been described above as selecting either the fast-slow rendition style or the slow-slow rendition style as a type of the release rendition style to be applied, it may of course select another release-related rendition style, such as the medium-fall rendition style, from among the plurality of release rendition styles. Needless to say, the same applies to the attack rendition styles.

Furthermore, although the second embodiment of the tone control apparatus has been described above in relation to the case where only one tone is generated and a selected release rendition style is imparted to the generated tone to silence the tone, the present invention is not so limited; of course, a plurality of release rendition styles may be imparted to a series of tones to silence the successive tones in response to operation of the pedal 6.

In the case of the polyphonic tone generation, a same release rendition style may be imparted compulsorily to all currently-generated tones, in response to turning-off operation of the pedal, so as to silence all of the currently-generated tones. In the case where the monophonic tone generation, on the other hand, the tone pitch to be sounded is replaced with a note of each newly-generated keyboard event information and the note at the time of turning-off of the pedal may be imparted with a release rendition style to silence the tone.

It should also be appreciated that the tone generation control of the present invention may be performed, in response to the operation of the pedal 6, using a combination of release rendition and attack rendition styles. Further, in each of the first and second embodiments, audible generation of tones may be instructed via any other performance operation means than the keyboard. Furthermore, the control of the present invention may be applied to tones generated by automatic performance apparatus as well as manual performance apparatus.

What is claimed is:

1. An electronic musical instrument comprising:

a first operation device that generates tone-generation-start instructing information and release-start instructing information in response to operation thereof by a human operator;

a second operation device that generates ON operation information and OFF operation information in response to turning-on operation and turning-off operation thereof, respectively, by a human operator;

a storage device that stores one or more rendition style parameters each for realizing a release rendition style characteristic of a release section of a tone;

a detection section that detects an operation time length from a time point when the ON operation information is generated by said second operation device to a time point when the OFF operation information is generated by said second operation device;

a selection section that, on the basis of the operation time length detected by said detection section, selects any one of the rendition style parameters stored in said storage device; and a tone generation control section that starts generation of a tone in accordance with the tone-generation-start instructing information generated by said first operation device and silences the generated tone in accordance with one of the release-start instructing information generated by said first operation device and the OFF operation information generated by said second operation device that is generated earlier than other, wherein said tone generation control section silences the generated tone in accordance with a standard release rendition style when the release-start instructing information has been generated earlier than the OFF operation information, but silences the generated tone in accordance with a release rendition style corresponding to the rendition style parameter selected via the selection section.

2. The electronic musical instrument as claimed in claim 1 wherein said second operation device comprises a pedal.

3. The electronic musical instrument as claimed in claim 1 wherein said first operation device comprises a plurality of keys operable by the human operator.

4. A method for controlling a tone using a storage device that stores one or more rendition style parameters each for realizing a release rendition style characteristic of a release section of a tone and on the basis of operation of a first and second operation device operable by a human operator, said method comprising:

a step of generating tone-generation-start instructing information and release-start instructing information in response to operation of the first operation device by a human operator;

a step of generating ON operation information and OFF operation information in response to turning-on operation and turning-off operation of the second operation device, respectively, by a human operator;

a detection step of detecting an operation time length from a time point when the ON operation information is generated by said second operation device to a time point when the OFF operation information is generated by said second operation device;

a selection step of, on the basis of the operation time length detected by said detection step, selecting any one of the rendition style parameters stored in said storage device;

a step of starting generation of a tone in accordance with the tone-generation-start instructing information generated by said first operation device; and a step of silencing the generated tone in accordance with one of the release-start instructing information generated by said first operation device and the OFF operation information generated by said second operation device that is generated earlier than other, wherein said step of silencing silences the generated tone in accordance with a standard release rendition style when the release-start instructing information has been generated earlier than the OFF operation information, but silences the generated tone in accordance with a release rendition style corresponding to the rendition style parameter selected by said selection step.

5. A computer-readable medium program on a computer memory containing a group of instructions for causing the computer to perform a tone control method, said method controlling a tone using a storage device that stores one or more rendition style parameters each for realizing a release rendition style characteristic of a release section of a tone and on the basis of operation of a first and second operation device operable by a human operator, said method comprising:

a step of generating tone-generation-start instructing information and release-start instructing information in response to operation of the first operation device by a human operator;

a step of generating ON operation information and OFF operation information in response to turning-on operation and turning-off operation of the second operation device, respectively, by a human operator;

a detection step of detecting an operation time length from a time point when the ON operation information is generated by said second operation device to a time point when the OFF operation information is generated by said second operation device;

a selection step of, on the basis of the operation time length detected by said detection step, selecting any one of the rendition style parameters stored in said storage device;

a step of starting generation of a tone in accordance with the tone-generation-start instructing information generated by said first operation device; and a step of silencing the generated tone in accordance with one of the release-start instructing information generated by said first operation device and the OFF operation information generated by said second operation device that is generated earlier than other, wherein said step of silencing silences the generated tone in accordance with a standard release rendition style when the release-start instructing information has been generated earlier than the OFF operation information, but silences the generated tone in accordance with a release rendition style corresponding to the rendition style parameter selected by said selection step.

6. An electronic musical instrument comprising:

a first operation device that generates tone-generation-start instructing information and release-start instructing information in response to operation thereof by a human operator;

a second operation device that generates ON operation information and OFF operation information in response to turning-on operation and turning-off operation thereof, respectively, by a human operator;

a storage device that stores one or more rendition style parameters each for realizing a release rendition style characteristic of a release section of a tone;

a detection section that detects, an operation time length from a later one of a time point when the tone-generation-start instructing information is generated by said first operation device and a time point when the ON operation information is generated by said second operation device to a time point when the OFF operation information is generated by said second operation device;

a selection section that, on the basis of the operation time length detected by said detection section, selects any one of the rendition style parameters stored in said storage device; and a tone generation control section that starts generation of a tone in accordance with the tone-generation-start instructing information generated by said first operation device and silences the generated tone in accordance with one of the release-start instructing information generated by said first operation device and the OFF operation information generated by said second operation device that is generated earlier than other, wherein said tone generation control section silences the generated tone in accordance with a standard release rendition style when the release-start instructing information has been generated earlier than the OFF operation information, but silences the generated tone in accordance with a release rendition style corresponding to the rendition style parameter selected via the selection section.

7. The electronic musical instrument as claimed in claim 6 wherein said second operation device comprises a pedal.

8. The electronic musical instrument as claimed in claim 6 wherein said first operation device comprises a plurality of keys operable by the human operator.

9. A method for controlling a tone using a storage device that stores one or more rendition style parameters each for realizing a release rendition style characteristic of a release section of a tone and on the basis of operation of a first and second operation device operable by a human operator, said method comprising:

a step of generating tone-generation-start instructing information and release-start instructing information in response to operation of the first operation device by a human operator;

a step of generating ON operation information and OFF operation information in response to turning-on operation and turning-off operation of the second operation device, respectively, by a human operator;

a detection step of detecting an operation time length from a later one of a time point when the tone-generation-start instructing information is generated by said first operation device and a time point when the ON operation information is generated by said second operation device to a time point when the OFF operation information is generated by said second operation device;

a selection step of, on the basis of the operation time length detected by said detection step, selecting any one of the rendition style parameters stored in said storage device;

a step of starting generation of a tone in accordance with the tone-generation-start instructing information generated by said first operation device; and a step of silencing the generated tone in accordance with one of the release-start instructing information generated by said first operation device and the OFF operation information generated by said second operation device that is generated earlier than other, wherein said step of silencing silences the generated tone in accordance with a standard release rendition style when the release-start instructing information has been generated earlier than the OFF operation information, but silences the generated tone in accordance with a release rendition style corresponding to the rendition style parameter selected by said selection step.

10. A computer-readable medium containing a group of instructions for causing the computer to perform a tone control method, said method controlling a tone using a storage device that stores one or more rendition style parameters each for realizing a release rendition style characteristic of a release section of a tone and on the basis of operation of a first and second operation device operable by a human operator, said method comprising:

a step of generating tone-generation-start instructing information and release-start instructing information in response to operation of the first operation device by a human operator;

a step of generating ON operation information and OFF operation information in response to turning-on operation and turning-off operation of the second operation device, respectively, by a human operator;

a detection step of detecting an operation time length from a later one of a time point when the tone-generation-start instructing information is generated by said first operation device and a time point when the ON operation information is generated by said second operation device to a time point when the OFF operation information is generated by said second operation device;

a selection step of, on the basis of the operation time length detected by said detection step, selecting any one of the rendition style parameters stored in said storage device;

a step of starting generation of a tone in accordance with the tone-generation-start instructing information generated by said first operation device; and a step of silencing the generated tone in accordance with one of the release-start instructing information generated by said first operation device and the OFF operation information generated by said second operation device that is generated earlier than other, wherein said step of silencing silences the generated tone in accordance with a standard release rendition style when the release-start instructing information has been generated earlier than the OFF operation information, but silences the generated tone in accordance with a release rendition style corresponding to the rendition style parameter selected by said selection step.

11. An electronic musical instrument comprising:

a performance device that instructs generation of a tone and silencing of a tone;

an operation device capable of being turned on and off by a human operator;

a storage device that stores one or more rendition style parameters each for realizing a rendition style characteristic of a release section of a tone;

a generation section that, when an ON operation event or OFF operation event of said operation device has been generated, generates a velocity value corresponding to operation velocity or acceleration of said operation device pertaining to the operation event;

a selection section that, on the basis of the velocity value generated by said generation section, selects any one of the rendition style parameters stored in said storage device; and a tone generation control section that performs control to start generation of a tone in accordance with response to a instruction given via said performance device and performs control to silence the generated tone to be silenced with a characteristic of in accordance with a release rendition style corresponding to the rendition style parameter selected by said selection section, in response to ON operation or OFF operation of said operation device, and that, when a tone-silencing instruction has been given via said performance device before the ON operation or OFF operation of said operation device is performed, performs control to silence the generated tone in accordance with a rendition style parameter for realizing a predetermine standard release.

12. The electronic musical instrument as claimed in claim 11 wherein said storage device stores the one or more rendition style parameters in association with tone pitches or tone pitch ranges, and said selection section selects any one of the rendition style parameters stored in said storage device on the basis of the velocity value generated by said generation section and a tone pitch or tone pitch range of the tone of which generation has been instructed via said performance device.

13. A method for controlling a tone using a storage device that stores one or more rendition style parameters each for realizing a release rendition style characteristic of a release section of a tone and on the basis of operation of an operation device operable by a human operator, said method comprising:

a step of generating a tone-generating instruction and a tone-silencing instruction in response to operation of a performance device by a human operator;

a generation step of, when an ON operation even or OFF operation event of said operation device has been generated, generating a velocity value corresponding to operator operation velocity or acceleration of said operation device pertaining to the operation event;

a selection step of, on the basis of the velocity value generated by of said generation step, selecting any one of the rendition style parameters stored in said storage device;

a step of performing control to start generation of a tone in response to the tone-generating instruction given via said performance device; and a step of performing control to silence the generated tone in accordance with a release rendition style corresponding to the rendition style parameter selected by said selection step, in response to ON operation or OFF operation of said operation device, and, when the tone-silencing instruction has been given via said performance device before the ON operation or OFF operation of said operation device is performed, performing control to silence the generated tone in accordance with a rendition style parameter for realizing a predetermined standard release.

14. A computer-readable medium containing a group of instructions for causing the computer to perform a tone control method, said method controlling a tone using a storage device that stores one or more rendition style parameters each for realizing a release rendition style characteristic of a release section of a tone and on the basis of operation of an operation device operable by a human operator, said method comprising:

a step of generating a tone-generating tone instruction and a tone-silencing instruction in response to operation of a performance device by a human operator;

a generation step of, when an ON operation event or OFF operation event of said operation device has been generated, generating a velocity value corresponding to operation velocity or acceleration of said operation device pertaining to the operation event;

a selection step of, on the basis of the velocity value generated by said generation step, selecting any one of the rendition style parameters stored in said storage device;

a step of performing control to start generation of a tone in response to the tone-generating instruction given via said performance device; and a step of performing control to silence the generated tone in accordance with a release rendition style corresponding to the rendition style parameter selected by said selection step, in response to ON operation or OFF operation of said operation device, and, when the tone-silencing instruction has been given via said performance device is performed, performing control to silence the generated tone in accordance with a rendition style parameter for realizing a predetermined standard release.

15. An electronic musical instrument comprising:

a performance device that instructs generation of a tone and silencing of a tone;

an operation device capable of being turned on and off by a human operator;

a storage device that stores one or more rendition style parameters each for realizing a rendition style characteristic of an attack section of a tone;

a generation section that, when an ON operation event or OFF operation event of said operation device has been generated, generates a velocity value corresponding to operation velocity or acceleration of said operation device pertaining to the operation event;

a selection section that, on the basis of the velocity value generated by said generation section, selects any one of the rendition style parameters stored in said storage device; and a tone generation control section that, when an ON operation event of said operation device has been generated, performs control to start generation of a tone in response to a tone-generating instruction given via said performance device and in accordance with an attack rendition style corresponding to the rendition style parameter selected by said selection section, but, when no ON operation event of said operation device has been generated, performs control to start generation of a tone in accordance with a rendition style parameter for realizing a predetermined standard attack.

16. The electronic musical instrument as claimed in claim 15 wherein said storage device stores the one or more rendition style parameters in association with tone pitches or tone pitch ranges, and said selection section selects any one of the rendition style parameters stored in said storage device on the basis of the velocity value generated by said generation section and a tone pitch or tone pitch range of the tone of which generation has been instructed via said performance device.

17. A method for controlling a tone using a storage device that stores one or more rendition style parameters each for realizing an attack rendition style characteristic of an attack section of a tone and on the basis of operation of an operation device operable by a human operator, said method comprising:

a step of generating a tone-generating instruction and a tone-silencing instruction in response to operation of a performance device by a human operator;

a generation step of, when an ON operation event or OFF operation event of said operation device has been generated, generating a velocity value corresponding to operation velocity or acceleration of said operation device pertaining to the operation event;

a selection step of, on the basis of the velocity value generated by said generation step, selecting any one of the rendition style parameters stored in said storage device; and a step of when an ON operation event of said operation device has been generated, performing control to start generation of a tone in response to the tone-generating instruction given via said performance device and in accordance with an attack rendition style corresponding to the rendition style parameter selected by said selection step, but, when no ON operation event of said operation device has been generated, performing control to start generation of a tone in accordance with a rendition style parameter for realizing a predetermined standard attack.

18. A computer-readable containing a group of instructions for causing the computer to perform a tone control method, said method controlling a tone using a storage device that stores one or more rendition style parameters each for realizing an attack rendition style characteristic of an attack section of a tone and on the basis of operation of an operation device operable by a human operator, said method comprising:

a step of generating a tone-generating instruction and a tone-silencing instruction in response to operation of a performance device by a human operator;

a generation step of, when an ON operation event or OFF operation event of said operation device has been generated, generating a velocity value corresponding to operation velocity or acceleration of said operation device pertaining to the operation event;

a selection step of, on the basis of the velocity value generated by said generation step, selecting any one of the rendition style parameters stored in said storage device; and a step of when an ON operation event of said operation device has been generated, performing control to start generation of a tone in response to the tone generating instruction given via said performance device and in accordance with an attack rendition style corresponding to the rendition style parameter selected by said selection step, but, when no ON operation event of said operation device has been generated, performing control to start generation of a tone in accordance with a rendition style parameter for realizing a predetermined standard attack.

* * * * *

UNITED STATES PATENT AND TRADEMARK OFFICE

CERTIFICATE OF CORRECTION

PATENT NO. : 7,470,855 B2
APPLICATION NO. : 11/091865
DATED : December 30, 2008
INVENTOR(S) : Masao Sakama et al.

It is certified that error appears in the above-identified patent and that said Letters Patent is hereby corrected as shown below:

Column 27, Line 55, Claim 11:
Delete “accordance with”
Column 27, Line 56, Claim 11:
Insert --tone generating-- before “instruction”
Column 27, Lines 57-58, Claim 11:
Delete “to be silenced with a characteristic of”
Column 28, Line 20, Claim 13:
“even” should be --event--
Column 28, Line 50, Claim 14:
Delete “tone”
Column 30, Line 21, Claim 18:
Insert --medium-- after “readable”

Signed and Sealed this

Twenty-first Day of April, 2009

John Doll

JOHN DOLL
*Acting Director of the United States Patent and Trademark Office*